US007083760B2

(12) United States Patent
Kondo et al.

(10) Patent No.: US 7,083,760 B2
(45) Date of Patent: Aug. 1, 2006

(54) METHOD OF FORMING A POWDER COMPACT

(75) Inventors: Mikio Kondo, Aichi-ken (JP); Yoji Awano, Aichi-ken (JP); Masatoshi Sawamura, Aichi-ken (JP); Hiroshi Okajima, Aichi-ken (JP); Shigehide Takemoto, Toyota (JP)

(73) Assignees: Kabushiki Kaisha Toyota Chuo Kenkyusho, Aichi-gun (JP); Toyota Jidosha Kabushiki Kaisha, Toyota (JP)

( * ) Notice: Subject to any disclaimer, the term of this patent is extended or adjusted under 35 U.S.C. 154(b) by 705 days.

(21) Appl. No.: 09/927,323

(22) Filed: Aug. 13, 2001

(65) Prior Publication Data

US 2002/0034453 A1 Mar. 21, 2002

Related U.S. Application Data

(63) Continuation-in-part of application No. PCT/JP00/08836, filed on Dec. 13, 2000.

(30) Foreign Application Priority Data

Dec. 14, 1999 (JP) ..... 11-354660

(51) Int. Cl.
*B22F 3/02* (2006.01)

(52) U.S. Cl. ..... 419/65; 419/66

(58) Field of Classification Search ..... 419/66, 419/65

See application file for complete search history.

(56) References Cited

U.S. PATENT DOCUMENTS 4,955,798 A 9/1990 Musella et al. ..... 419/31
5,468,401 A * 11/1995 Lum et al. ..... 508/115
5,767,426 A * 6/1998 Oliver et al. ..... 252/62.53
5,782,954 A * 7/1998 Luk ..... 419/19
6,013,225 A * 1/2000 Cadle et al. ..... 419/29
6,261,514 B1 * 7/2001 Lindberg et al. ..... 419/11
6,344,169 B1 * 2/2002 Tsuchida et al. ..... 419/38
6,355,208 B1 * 3/2002 Unami et al. ..... 419/11
6,395,687 B1 * 5/2002 Hanejko ..... 419/61

FOREIGN PATENT DOCUMENTS

JP 62-109902 5/1987
JP 62-294102 12/1987

(Continued)

OTHER PUBLICATIONS

Y. Thomas, et al. Influence of Temperature on Properties of Lithium Stearate Lubricant, Powder Metallurgy & Particulate Materials, vol. 1, 1997, pp. 4–23 to 4–34.

*Primary Examiner*—Ngoclan Mai
(74) *Attorney, Agent, or Firm*—Oblon, Spivak, McClelland, Maier & Neustadt, P.C.

(57) ABSTRACT

This invention provides a method of forming a powder compact which can produce a high density compact under a high pressure and at the same time can reduce pressure for ejecting the compact from a die.

This method comprises the application step of applying a higher fatty acid lubricant to an inner surface of a heated die, and the compaction step of filling metal powder into the die and compacting the metal powder under such a pressure as to force the higher fatty acid lubricant to be chemically bonded with the metal powder and form a metallic soap coating. Since the metallic soap coating is formed between the die and a compact, friction force between the die and the compact is decreased and ejecting pressure can be remarkably decreased despite of compaction with high pressure. Besides, a high density compact can be obtained owing to the compaction with high pressure.

20 Claims, 20 Drawing Sheets

FOREIGN PATENT DOCUMENTS

| | | |
|---|---|---|
| JP | 5-271709 | 10/1993 |
| JP | H11-271709 | 10/1993 |
| JP | H8-100203 | 4/1996 |
| JP | 9-104902 | 4/1997 |
| JP | 10-317001 | 12/1998 |
| JP | H11-100602 | 4/1999 |
| JP | H11-140505 | 5/1999 |
| JP | 11-193404 | 7/1999 |
| JP | 2000-199002 | 7/2000 |
| JP | 2000-273502 | 10/2000 |
| WO | WO 98-41347 | 9/1998 |

* cited by examiner

No. 1 No. 4 No. 5

RELATIONSHIP BETWEEN LUBRICANT COATING THICKNESS AND EJECTING PRESSURE (150°C, 784MPa)

METHOD OF FORMING A POWDER COMPACT

This is a Continuation-In-Part of PCT application PCT/JP00/08836 filed Dec. 13, 2000, which in turn is based on Japanese application 11-354660 filed Dec. 14, 1999, the entire contents of each of which is incorporated herein by reference.

TECHNICAL FIELD

The present invention relates to a method of forming a powder compact. Particularly it relates to a method of forming a powder compact which can obtain a high density powder compact and at the same time can reduce pressure for ejecting a powder compact from a die.

TECHNICAL BACKGROUND

Powder metallurgy is the art of compacting powder to form a powder compact (hereinafter appropriately abbreviated as 'a compact') and sintering this compact to produce a sintered body. In this powder metallurgy, it is necessary to obtain a high density compact in order to obtain a sintered body with a high dimensional accuracy and a high density. To satisfy this need, it is necessary to increase compacting pressure for forming a compact.

As a method for producing a high density sintered body, a method comprising compacting twice and sintering twice, and powder metal forging have been carried out conventionally. These methods also need to obtain a high density compact in order to obtain a high density sintered body, and therefore, need to increase pressure for compacting powder.

In the case of applying a high compacting pressure, however, pressure for ejecting a compact from a die inevitably becomes high. When the ejecting pressure is high, there arise problems such as cracking and splitting of a compact and galling of a die. Therefore, the art of keeping the ejecting pressure low has been conventionally seeked for.

An example of this kind of art is to use a lubricant to reduce friction between a compact and a die in ejecting the compact. U.S. Pat. No. 4,955,798 discloses a warm compaction process in which powder and a die are heated to about 150° C. or less. This patent also discloses compaction carried out by using, as a lubricant to be mixed in powder, a metal stearate lubricant such as zinc stearate and lithium stearate or a wax lubricant in order to reduce pressure of ejecting a compact from a die. Japanese Unexamined Patent Publication (KOKAI) Nos. H05-271,709, H11-140,505, H11-100,602 and so on disclose methods of producing raw material powder containing a warm compaction lubricant and compaction methods using raw material powder containing a warm compaction lubricant. In addition, Japanese Unexamined Patent Publication (KOKAI) No. H8-100,203 discloses a method of applying a lubricant electrostatically to a die.

A study titled "INFLUENCE OF TEMPERATURE ON PROPERTIES OF LITHIUM STEARATE LUBRICANT" (Powder Metallurgy & Particulate Materials vol. 1, 1997) has been also published and this study discusses that when lithium stearate is used as a lubricant, as compaction temperature is higher, ejecting pressure is higher.

An iron-based sintered body has been demanded to have a higher density on the purpose of strength enhancement and volume reduction, and at the same time to attain higher dimensional accuracy and lower production costs.

Accordingly, in order to obtain a high density sintered body by compacting and sintering only once, pressure for compacting powder must be high. In the conventional methods, however, an increase in compacting pressure accompanies a high ejecting pressure, which causes a problem that compaction cannot be continued because of degradation of compact surfaces and galling of a die.

Accordingly, it is an object of the present invention to provide a method of forming a powder compact which can produce a high density compact with a high compacting pressure and at the same time can reduce pressure for ejecting a compact from a die.

DISCLOSURE OF THE INVENTION

The present inventors have discovered as a result of study that when lithium stearate as a higher fatty acid lubricant is applied to an inner surface of a die, and iron powder heated to 150° C. is charged into the die heated to the same temperature and compacted, contrary to expectations, ejecting pressure in the case of compaction with a compacting pressure of 686 MPa is smaller than that in the case of compaction with a compacting pressure of 588 MPa. This discovery disproves an established theory that when powder is formed into a compact under a high pressure, high pressure is necessary to eject this compact. The present inventors have further studied and discovered that iron stearate adheres to a surface of a compact which has been produced by applying lithium stearate to an inner die surface and compacting iron powder with a compacting pressure of 981 MPa.

Moreover, the present inventors have confirmed that when calcium stearate or zinc stearate is applied and iron powder is compacted by using a die and iron powder both heated to 105° C., a similar phenomenon is observed, that is, the compacting pressure above a certain value brings a decrease in pressure for ejecting a compact.

The present inventors have studied on these phenomena and reached the following assumption: When a higher fatty acid lubricant such as lithium stearate is applied to an inner surface of a heated die, a thin lubricant coating exists on the inner surface of the die. When heated metal powder is filled into the die with the lubricant coating and compacted under a pressure above a certain value, the present inventors have assumed that what is called 'mechanochemical reaction' is caused between the metal powder and the higher fatty acid lubricant, and owing to this mechanochemical reaction, the metal powder and the higher fatty acid lubricant are chemically bonded with each other to form a metallic soap coating, although the details of mechanism is not clarified yet. Then they have thought that this metallic soap coating is very strongly bonded with metal powder and lubricating performance higher than that of the higher fatty acid lubricant adhering physically to the inner surface of the die is exhibited, and that this coating remarkably reduces friction force between the die and the compact.

Therefore, the present inventors have invented a method of forming a powder compact which is characterized by comprising the application step of applying a higher fatty acid lubricant to an inner surface of a heated die, and the compaction step of filling metal powder into the die and compacting the metal powder under such a pressure as to force the higher fatty acid lubricant to be chemically bonded with the metal powder and form a metallic soap coating.

When a die which has been heated and applied with a higher fatty acid lubricant such as lithium stearate on an inner surface is used and heated metal powder is filled into this die and compacted under such a pressure as to force this metal powder and the higher fatty acid lubricant to be chemically bonded with each other and form a metallic soap coating, it is assumed that a metallic soap coating is formed on the inner die surface. As a result, friction force between a metal powder compact and the die is decreased and pressure for ejecting the compact can be small. Since compaction is carried out with the die heated, it is also assumed that this heat promotes chemical bonding of the higher fatty acid lubricant and the metal powder, and the metallic soap coating becomes easily formed. Moreover, since compaction is carried out under such a pressure as to form a metallic soap coating, a high density compact can be formed. It is to be noted that the higher fatty acid lubricant mentioned here includes both lubricants composed of higher fatty acid and lubricants composed of metal salts of higher fatty acid.

The present inventors have also invented a method of forming a powder compact which is characterized by comprising the application step of applying a metal salt of higher fatty acid to an inner surface of a die heated to 100° C. or more and the compaction step of filling iron powder into the die and compacting the iron powder under not less than 600 MPa.

Namely, when a die which has been heated to 100° C. or more and applied with such a metal salt of higher fatty acid as lithium stearate on an inner surface is used and iron powder is pressed under not less than 600 MPa, it is assumed that the heating of the die to 100° C. or more promotes chemical bonding of the metal salt of higher fatty acid and the iron powder, and a coating of an iron salt of higher fatty acid, for example, a monomolecular film of iron stearate is formed on a compact surface. As a result, friction between the iron powder compact and the die is decreased and pressure for ejecting the compact can be small. Besides, since compaction is carried out with a high pressure of not less than 600 MPa, a high density compact can be formed.

MODES FOR CARRYING OUT THE INVENTION

Figure 1:
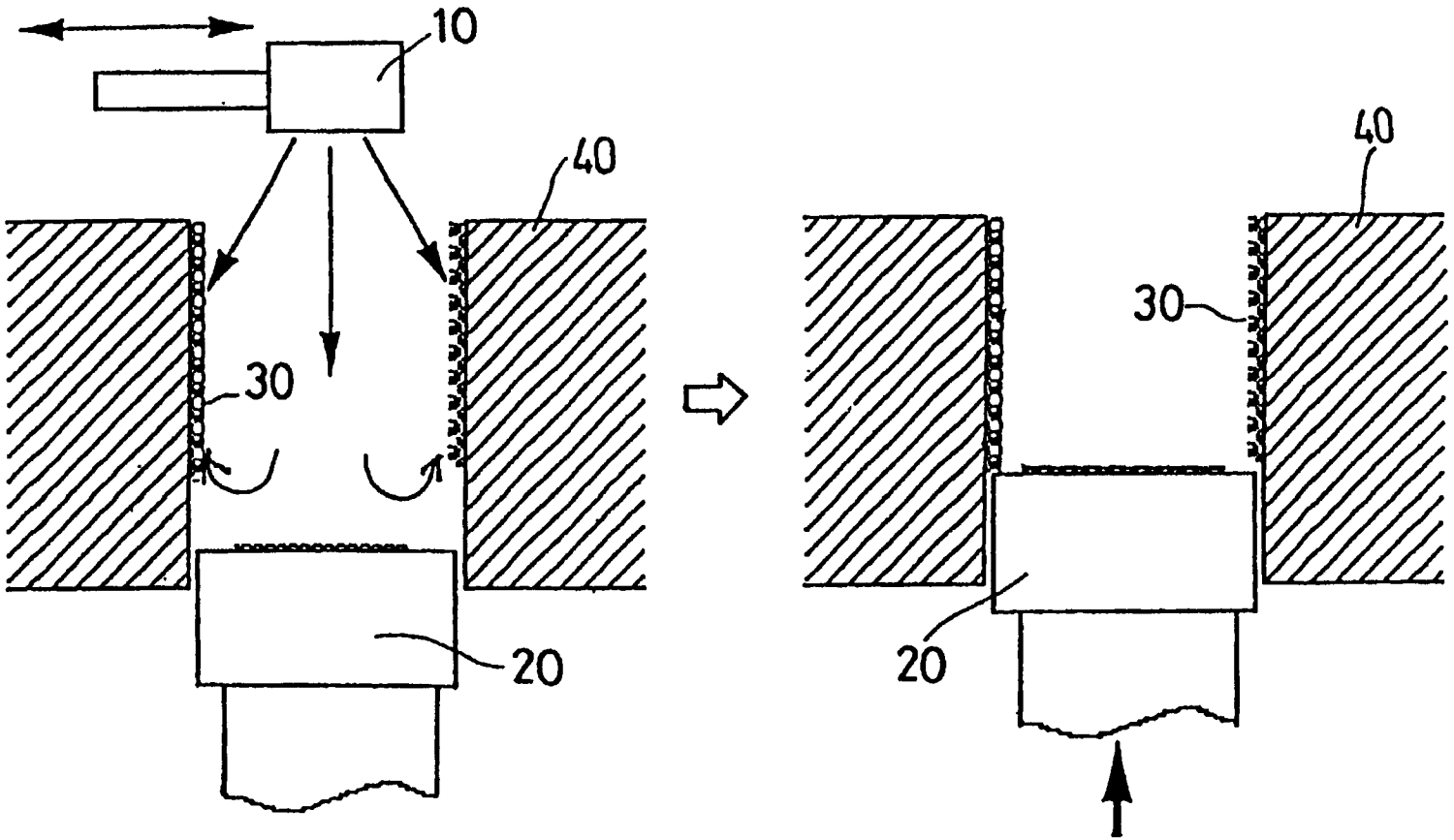
FIG. 1 is schematic views showing how a higher fatty acid lubricant is applied to an inner die surface by using a spray gun.

Hereinafter, modes for carrying out the method of forming a powder compact according to the present invention (hereinafter appropriately abbreviated as 'the forming methods') will be described in detail.

The forming method of the present invention comprises the application step of applying a higher fatty acid lubricant to an inner surface of a heated die, and the compaction step of filling metal powder into this die and compacting the metal powder under such a pressure as to force the higher fatty acid lubricant to be chemically bonded with the metal powder and form a metallic soap coating. Namely, the forming method of the present invention comprises the application step and the compaction step.

The application step is a step of applying a higher fatty acid lubricant to an inner surface of a heated die.

As mentioned before, the higher fatty acid lubricant used here includes both lubricants composed of higher fatty acid and lubricants composed of metal salts of higher fatty acid. Examples of the higher fatty acid lubricant used here include lithium stearate, calcium stearate, zinc stearate, barium stearate, lithium palmitate, lithium oleate, calcium palmitate and calcium oleate.

It is preferable that the higher fatty acid lubricant is a metal salt of higher fatty acid. When the lubricant is a metal salt of higher fatty acid, it is assumed that the metal salt of higher fatty acid is more easily chemically bonded with metal powder at a certain temperature and under a certain pressure, there forming a coating of a metal salt of higher fatty acid. It is more preferable that this metal salt of higher fatty acid is a lithium salt, a calcium salt or a zinc salt of higher fatty acid. In this case, pressure for ejecting a compact which is formed by compacting metal powder can be small. That is, it is assumed that these materials are more easily chemically bonded with metal powder to form a coating of a metal salt of higher fatty acid easily. For example, these materials are chemically bonded with iron powder to form a coating of iron stearate and as a result the ejecting pressure can be small.

It is preferable that the higher fatty acid lubricant is solid. When the lubricant is liquid, there arises a problem that the lubricant is liable to flow downward and it is difficult to apply the lubricant uniformly to an inner die surface. There also arises a problem that metal powder becomes lumpy.

Moreover, it is preferable that the higher fatty acid lubricant is dispersed in water. When a lubricant dispersed in water is applied to a die heated to 100° C. or more, the water evaporates instantly and a uniform lubricant coating can be formed. Since the lubricant is dispersed in not an organic solvent but water, environmental problems can be avoided. It is also preferable that particles of the higher fatty acid lubricant dispersed in water have the maximum diameter of less than 30 μm. When there are particles of 30 μm or more, the lubricant coating does not become uniform, and when dispersed in water, the particles of the higher fatty acid sediment easily and uniform lubricant application becomes difficult.

The higher fatty acid lubricant having the maximum particle diameter of less than 30 μm and dispersed in water can be prepared as follows. First, a surfactant is mixed in water to be added to a higher fatty acid lubricant.

As a surfactant, it is possible to employ such an alkyl phenol surfactant as polyoxyethylene nonylphenyl ether (EO) 6 and polyoxyethylene nonylphenyl ether (EO) 10 and such an anionic non-ionic surfactant as boric acid ester Emulbon T-80 and other known surfactants. One or more, if necessary, of these surfactants can be added in an appropriate amount.

For example, when lithium stearate is used as a higher fatty acid lubricant, it is preferable to add simultaneously three kinds of surfactants, polyoxyethylene nonylphenyl ether (EO) 6, polyoxyethylene nonylphenyl ether (EO) 10 and boric acid ester Emulbon T-80. This is because lithium stearate is not dispersed in water containing only boric acid ester Emulbon T-80. This is also because lithium stearate can be dispersed in water containing only polyoxyethylene nonylphenyl ether (EO) 6 or (EO) 10 but cannot be properly dispersed when the solution is further diluted as mentioned later. Therefore, it is preferable to add the three kinds of surfactants appropriately in combination.

The total amount of surfactants added is preferably from 1.5 to 15% by volume based on 100% by volume of the total volume of the aqueous solution. As the surfactants are added in a larger amount, lithium stearate can be dispersed in a larger amount. However, as the surfactants are added in a larger amount, viscosity of the aqueous solution is increased and it becomes difficult to decrease the particle size of lithium stearate in the lubricant pulverization process mentioned later.

In addition to this, a small amount of antifoaming agent, for example, silicon-based antifoaming agent can be added. This is because if much foam is generated in the lubricant pulverization process, it is difficult to form a uniform lubricant coating in applying the lubricant. In general, the amount of antifoaming agent added is 0.1 to 1% by volume based on 100% by volume of the aqueous solution.

Next, higher fatty acid lubricant powder is added and dispersed in the aqueous solution thus containing the surfactant. For example, when lithium stearate powder is dispersed in the aqueous solution, 10 to 30 g lithium stearate powder can be dispersed in 100 $cm^3$ of the aqueous solution. Then this aqueous solution in which the higher fatty acid lubricant is dispersed is subjected to a ball-mill pulverization process by using a teflon-coated steel ball. The ball should have a diameter of 5 to 10 mm, because pulverization efficiency declines when the ball diameter is too small or too large. Preferably, the volume of the ball is almost the same as that of the solution to be treated. In this case, pulverization efficiency is supposed to be the maximum. The capacity of a vessel to be used for the ball-mill pulverization process is preferably 1.5 to 2 times of the total volume of the solution to be treated and the ball. Similarly, in this case the pulverization efficiency is supposed to be the maximum.

It is preferable that time for the pulverization process is approximately 50 to 100 hours. For example, owing to this, lithium stearate powder is pulverized into particles of less than 30 μm in maximum diameter and becomes dispersed and suspended in the solution.

The higher fatty acid lubricant is applied to an inner surface of a die. When the higher fatty acid lubricant is applied to an inner surface of a die, a 10 to 20 times dilution of the aqueous solution treated by the ball-mill pulverization process is used for application. In the case of diluting the aqueous solution, it is preferable to dilute the aqueous solution so as to contain 0.1 to 5% by weight of the higher fatty acid lubricant based on 100% by weight of the total weight of the diluted aqueous solution. It is more preferable to dilute the solution so as to contain 0.5 to 2% by weight of the lubricant. This dilution allows formation of a thin uniform lubricant coating.

The aqueous solution thus diluted can be applied by being sprayed by a spray gun for coating. The amount of the aqueous solution to be applied can be adjusted appropriately in accordance with a die size while using a spray gun controlled to spray the solution at about 1 $cm^3$/sec. The thickness of the lubricant coating on the inner die surface is desirably 0.2 to 2 μm. It is more desirably 0.5 to 1.5 μm. With the thickness of 0.2 μm or less, the ejecting pressure increases and galling tends to occur. On the other hand, with the thickness of 2 μm or more, the ejecting pressure is satisfactorily small, but not a small amount of lubricant remains on the surface of a compact and becomes pores after sintering. This might lead to a decrease in strength.

Figure 2:
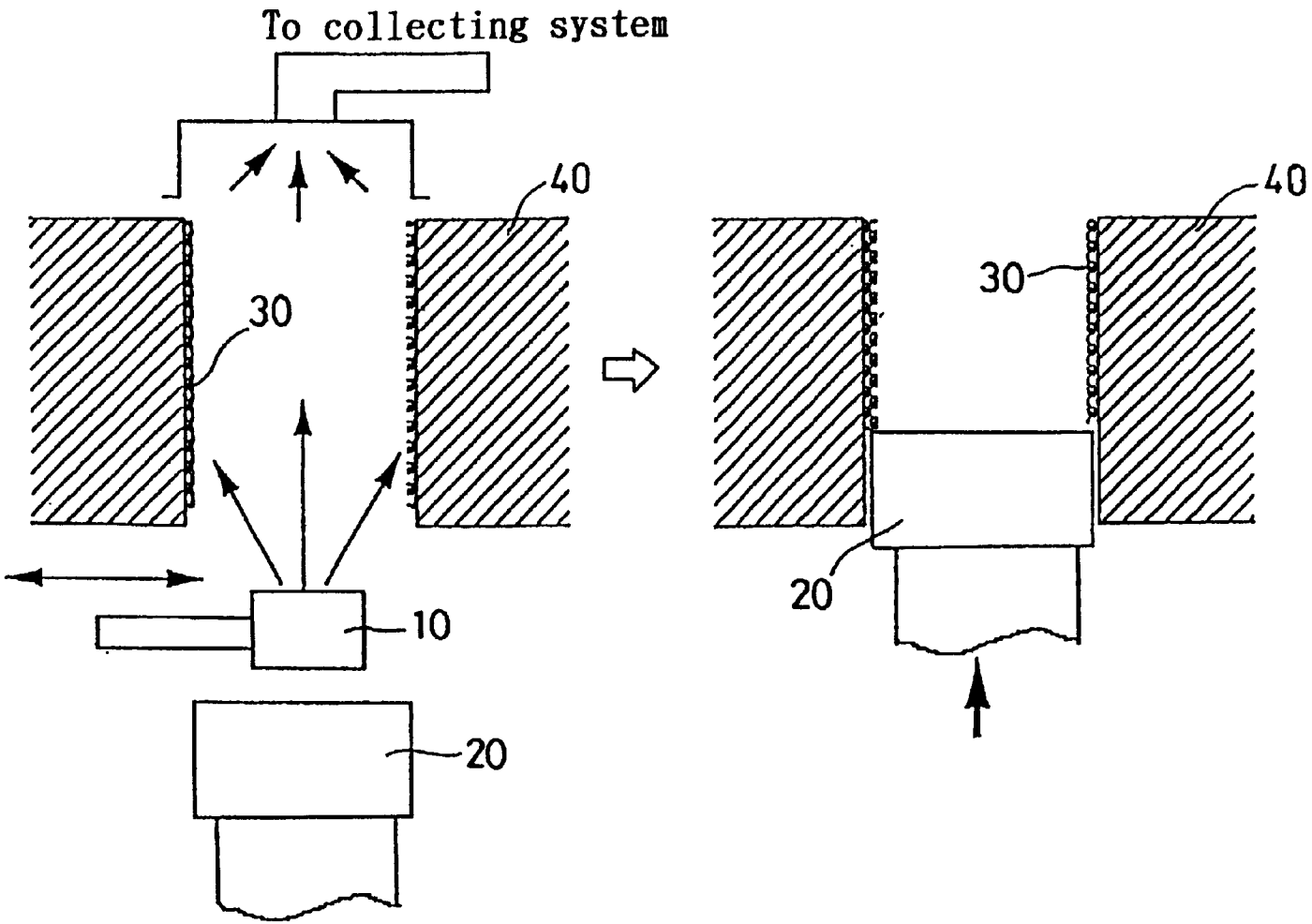
FIG. 2 is schematic views showing how a higher fatty acid lubricant is applied to an inner die surface by using a spray gun.

When the lubricant uniformly is to be sprayed to an inner die surface, there arises a problem that when the solution is sprayed with a lower punch set at a regular position, the solution does not adhere to a part of die near the lower punch. To avoid this, as shown in FIG. 1, it is possible to move a lower punch 20 downward from the regular position beforehand, spray the solution by a spray gun 10 and then push up the lower punch 20 to the regular position. Instead, as shown in FIG. 2, it is also possible to take out the lower punch 20 from dies 40 before spraying, transfer the spray gun 10 to a position below the dies 40 and spray the lubricant upward. When the lubricant is thus sprayed upward, it is preferable to provide a system for collecting excess lubricant in order to prevent the lubricant which has not adhered to the dies 40 from scattering upward. By providing this system to the dies 40, a constantly uniform lubricant coating 30 can be formed on an inner surface of the die 40 and seizure caused by defective lubricant coating can be prevented. In addition, damage on operational environment can also be prevented.

As a process of applying the higher fatty acid lubricant to the inner die surface, application by using an electrostatic painting apparatus such as an electrostatic gun is possible in addition to spraying by a spray gun.

The die used in this application step can be an ordinary die for forming a compact in the field of powder metallurgy.

Since compaction is carried out with a high pressure, it is desirable to employ a die which is excellent in strength. It is also preferable that the inner surface of a die is subjected to TiN coating treatment or the like to decrease surface roughness. Only with this coating treatment, friction is reduced and the surface of a compact becomes smooth.

The die used in this application step is heated. By heating the die, the higher fatty acid lubricant applied to the die and metal powder near the higher fatty acid lubricant are both heated, so the higher fatty acid lubricant and the metal powder become easily chemically bonded with each other under a certain pressure, thereby forming a metallic soap coating easily. Therefore, the ejecting pressure can be small. Moreover, since the die is heated to 100° C. or more, water in which the higher fatty acid lubricant is dispersed is instantly evaporated and a uniform lubricant coating can be formed on the inner die surface. Die heating can be carried out by ordinary methods. For instance, the die can be heated by an electric heater.

It is preferable that the die is heated to 100° C. or more. In this case, it is assumed that the metal powder and the higher fatty acid lubricant become easily chemically bonded with each other under a certain pressure, thereby forming a metallic soap coating easily. It is also preferable that the die temperature is less than the melting point of the higher fatty acid lubricant. When the die temperature is at or above the melting point, the higher fatty acid lubricant is melted and is liable to flow downward on the die inner surface and as a result, a uniform lubricant coating cannot be formed. There also arises a problem that metal powder becomes lumpy. For example, when lithium stearate is used as a higher fatty acid lubricant, the temperature of the heated die is preferably below the melting point of lithium stearate, 220° C.

The compaction step is a step of filling metal powder into the heated die and compacting the metal powder under such a pressure as to force the higher fatty acid lubricant to be chemically bonded with the metal powder and form a metallic soap coating.

Metal powder is filled into the die which has been applied with the higher fatty acid lubricant in the application step. The metal powder used herein can be not only such metal powder as iron powder but also intermetallic compound powder, metal-nonmetal compound powder, and mixed powder of different metal powders. It can also be mixed powder of metal powder and nonmetal powder. It is to be noted that the iron powder mentioned herein includes not only what is called pure iron powder but also iron alloy powder composed principally of iron. Accordingly the metal powder used herein can be, for example, mixed powder of steel powder and graphite powder.

Appropriate metal powder is employable as metal powder and can be pelletized powder or coarse grain powder. That is to say, it is possible to employ general metal powder for powder metallurgy of not more than 200 μm in particle diameter and about 100 μm in average particle diameter. Additive powder (Gr (graphite), Cu) can be common powder of not more than 40 μm in particle diameter. It is to be noted that the metal powder can be mixed by a generally used mixer.

It is preferable that the metal powder is heated, because pressure for ejecting a compact can be reduced. By heating also the metal powder, it is assumed that the metal powder becomes easily chemically bonded with the higher fatty acid lubricant and forms a metallic soap coating easily.

Preferably the metal powder contains iron powder. It is supposed that this powder is chemically bonded with the higher fatty acid lubricant and forms a coating of an iron salt of the higher fatty acid. This iron salt coating is so strongly bonded with iron powder that the coating exhibits superior lubricating performance to that of the original lubricant physically adhering and remarkably reduces friction force between the die and a compact and accordingly reduces pressure for ejecting the compact.

Preferably the metal powder is added with graphite powder. This contributes to a decrease in the ejecting pressure. The graphite powder in itself has a lubricating effect, so addition of graphite powder leads to a decrease in contact area between the iron powder and the die and a decrease in the ejecting pressure.

Besides, it is preferable that the metal powder used herein contains a higher fatty acid lubricant. For example, the metal powder can contain lithium stearate, calcium stearate and zinc stearate. The preferable range of the higher fatty acid lubricant added is not less than 0.1% by weight and less than 0.6% by weight based on 100% by weight of the total weight of the metal powder. When the lubricant is added in an amount of not less than 0.1% by weight and less than 0.6% by weight, the metal powder is remarkably improved in flowability and density of the powder packed in the die can be increased. So this is advantageous in forming a high density compact. However, as the lubricant is added in a larger amount, ultimate density of a compact formed under high pressure becomes smaller.

Pressure for compacting the metal powder in the die is such a pressure as to force the higher fatty acid lubricant to be chemically bonded with the metal powder and form a metallic soap coating. It is supposed that by thus applying such a pressure as to form a metallic soap coating, a metallic soap coating is formed between the die and a compact formed by compaction. This coating has a very strong bond with the metal powder and exhibits superior lubricating performance to that of the lubricant coating physically adhering and remarkably reduces friction force between the die and the compact. Besides, since the compact is formed by warm compaction with a high compacting pressure, density of the compact can be sharply increased in comparison with that of a compact formed by compaction at room temperature.

Since pressure required for producing a metallic soap coating depends on the kind of higher fatty acid lubricant to be applied to the die, compaction should be carried out by controlling the compacting pressure in accordance with the kind of higher fatty acid lubricant to be used.

For instance, when iron powder is compacted by using a metal salt of higher fatty acid, e.g., lithium stearate as a higher fatty acid lubricant to be applied to an inner surface of a die, the die should be heated to 100° C. or more and compaction should be carried out under a pressure of not less than 600 MPa. Namely, when compaction is carried out under a pressure of not less than 600 MPa, iron powder and a metal salt of higher fatty acid are chemically bonded with each other and a coating of an iron salt of the higher fatty acid is formed between a green compact and the die, and as a result, pressure for ejecting the compact decreases. Besides, since compaction is carried out under a high pressure of not less than 600 MPa, a high density compact can be obtained.

In this case, compaction with a pressure of not less than 785 MPa is more preferable. In this case, it is more preferable to set the die temperature in the range from about 120 to 180° C. In this temperature range, a metal salt of higher fatty acid and iron powder are easy to be chemically bonded with each other and form a coating of an iron salt coating of higher fatty acid, and as a result pressure for ejecting a compact is remarkably reduced.

Moreover, in this case it is more preferable that the metal salt of higher fatty acid is a lithium salt, a calcium salt or a zinc salt of higher fatty acid, because pressure for ejecting a compact is reduced.

A compact thus formed can be ejected by ordinary methods. Since a metallic soap coating is formed between the die and the compact, the compact can be ejected with smaller ejecting pressure than the conventional pressure. Besides, owing to compaction with a high compacting pressure, a high density compact can be obtained. The ejecting pressure can be not more than 3% of the compacting pressure.

Following is a time schedule of the forming method of the present invention.

① A die is heated to a predetermined die temperature of 100° C. or more beforehand.

② A dispersion in which a metal salt of higher fatty acid having a higher melting point than the die temperature is finely dispersed is applied to a die surface, thereby forming a coating of the metal salt of higher fatty acid on the die surface.

③ Iron powder is filled into the die and compaction is carried out with a compacting pressure of not less than 600 MPa. Thus obtained is a compact having a metallic soap coating on a surface which is contact with the die.

④ Then, owing to lubricating characteristics of the metallic soap coating, the compact is ejected and taken out from the die under an ejecting pressure of not more than 3% of the compacting pressure.

It is to be noted that the above iron powder includes such powder composed mainly of iron as pure iron and alloy steel, and mixed powder of pure iron or alloy steel with copper, graphite or the like.

Preferred Embodiments

As preferred embodiments higher fatty acid lubricants were prepared and powder compacts were formed. For comparison, powder compacts were formed as comparative examples.

Preparation of Higher Fatty Acid Lubricants

Powder of lithium stearate (LiSt) having a melting point of about 225° C. was prepared as a higher fatty acid lubricant and this lithium stearate powder was dispersed in water.

Table 1 shows conditions of dispersing lithium stearate powder in water. Nos. 1 to 4 are water dispersions of lithium stearate powder of less than 30 μm in maximum particle diameter, and No. 5 is a water dispersion of lithium stearate powder of more than 30 μm in maximum particle diameter. The maximum particle diameter includes the maximum diameter of an aggregate of respective particles.

TABLE 1

| | SURFACTANT AMOUNT | LiSt AMOUNT/ 100 $cm^3$ | PULVER-IZATION TIME | DILUTION RATE |
|---|---|---|---|---|
| No. 1 | 15 vol. % | 25 g | 100 hours | 20 |
| No. 2 | 3 vol. % | 12.5 g | 100 hours | 10 |
| No. 3 | 1.5 vol. % | 12.5 g | 100 hours | 10 |
| No. 4 | 15 vol. % | 25 g | 50 hours | 20 |
| No. 5 | 15 vol. % | 25 g | 5 hours | 20 |

② For dispersing lithium stearate, first surfactants and an antifoaming agent were added to water to prepare an aqueous solution of the surfactants and the antifoaming agent.

The surfactants employed were polyoxyethylene nonylphenyl ether (EO) 6, (EO) 10 and boric acid ester Emulbon T-80.

The total amount of these three kinds of surfactants added to Nos. 1 to 5 based on 100% by volume of the aqueous solution is shown in the line of 'SURFACTANT AMOUNT' of Table 1. The volume ratio of (EO)6: (EO)10: boric acid ester emulbon T-80 was 1:1:1.

The antifoaming agent used was based on silicon and added by 0.3% by volume based on 100% volume of the aqueous solution.

③ Lithium stearate powder was added and dispersed in the surfactant-added aqueous solution. The amount of lithium stearate powder dispersed in 100 $cm^3$ of the aqueous solution is shown in Table 1.

Next, this aqueous solution in which lithium stearate powder was dispersed was subjected to a ball-mill pulverization treatment by using a teflon-coated steel ball. The steel ball had a diameter of 10 mm. The volume of the ball used was almost the same as that of the treated aqueous solution. The capacity of a vessel used for the ball-mill pulverization treatment was about twice the total volume of the aqueous solution and the ball. The time for pulverization treatment is shown in Table 1. This pulverization treatment made lithium stearate powder dispersed and suspended in the aqueous solution.

Then this aqueous solution in which lithium stearate powder was dispersed and suspended was diluted with water. The rate of dilution is shown in Table 1.

④ This diluted aqueous solution was sprayed to an inner surface of a die heated to 150° C. by using a painting spray gun which was controlled to spray at about 1 $cm^3$/second.

Figure 3:
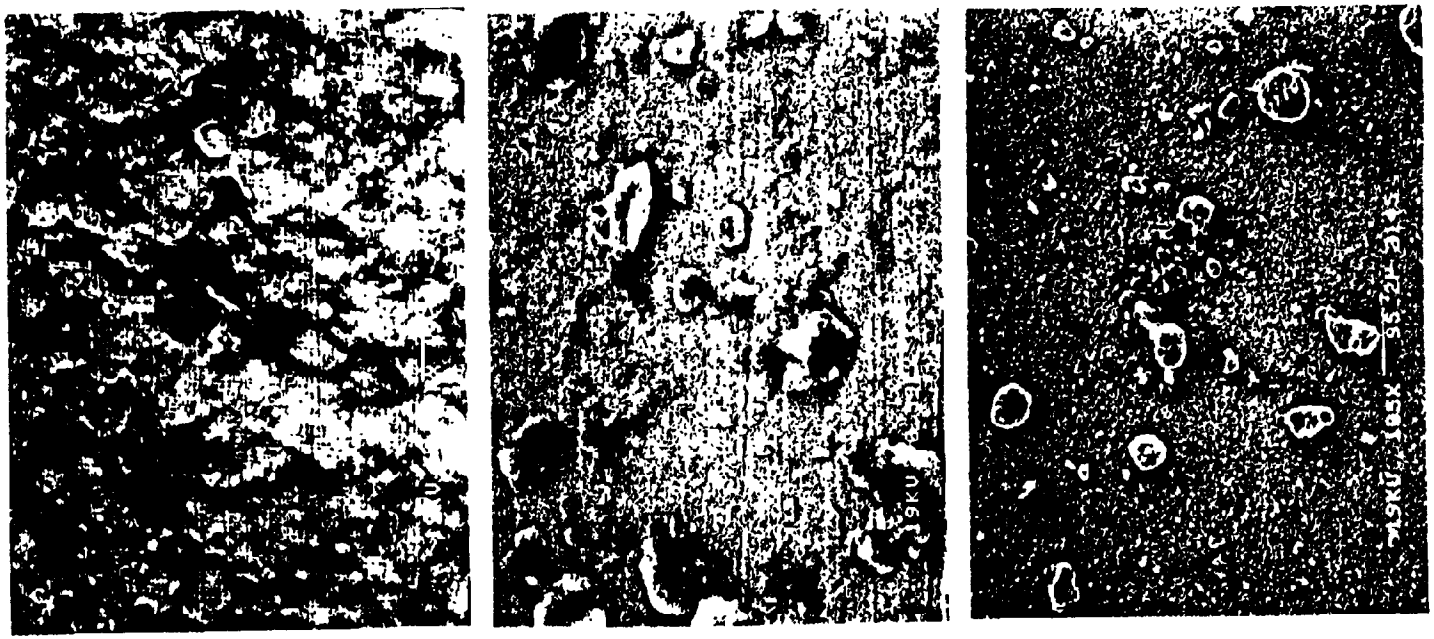
FIG. 3 is photographs showing that three kinds of lithium stearate having different particle diameters are applied and adhere to a die heated to 150° C.

⑤ FIG. 3 is photographs showing that lithium stearate of Nos. 1, 4 and 5 adhered to the die heated to 150° C. after sprayed. In No. 1, fine particles adhered to the die uniformly. In No. 4, a few coarse particles were observed but particles of not less than 30 μm or more in particle diameter were not seen. In No. 5, coarse particles of not less than 30 μm or more in particle diameter were observed. It is to be noted that in No. 5, a lithium stearate coating formed by spraying was not uniform and besides, application by the spray gun in itself was difficult without constantly stirring the aqueous solution in which lithium stearate powder was dispersed, because lithium stearate particles sediment in the aqueous solution.

Formation of Powder Compacts

Examples 1 to 4

Powder compacts were formed by using the lubricants of Nos. 1 to 4 prepared in the above (Preparation of Higher Fatty Acid Lubricant).

The above lubricants of Nos. 1 to 4 were sprayed to an inner surface of a die heated to 150° C. The die used had an inner diameter of 17 mm and was formed of cemented carbide. Its inner surface had been finished with TiN coating treatment and had a surface roughness of 0.4 Z according to ten points average roughness (Japanese Industrial Standards B0601).

Next, metal powder heated to 150° C. was filled into the above die and pressed under a compacting pressure of 785 MPa to produce a compact. The same metal powder was used for all of Examples 1 to 4. This powder was prepared by adding graphite powder and lithium stearate powder as an inner lubricant to alloy steel powder KIP103V produced by Kawasaki Steel Corporation in Japan (hereinafter appropriately abbreviated as '103V') and rotating them for mixing for one hour. The amount of graphite powder added was 0.5% by weight and the amount of lithium stearate powder added was 0.3% by weight, based on 100% by weight of the total weight of the metal powder. The composition of alloy steel powder KIP103V produced by Kawasaki Steel Corporation was Fe-1 wt. % Cr-0.3 wt. % Mo-0.3 wt. % V.

Comparative Example 1

For comparison with the lubricants applied to the die, a spray type lubricant, dry fluororesin U-NONS produced by Nippon Valqua Industries, Ltd. in Japan (hereinafter appropriately abbreviated as 'U-NONS') was applied to the inner surface of the die. Then a powder compact was formed under the same conditions as those of the examples. Thus obtained was Comparative Example 1.

Comparative Example 2

For comparison with the inner lubricant added to the metal powder, employed was metal powder added by 0.8% by weight of lithium stearate powder instead of 0.3% by weight of lithium stearate added as an inner lubricant.

No lubricant was applied to the inner die surface. A powder compact was formed by compacting the metal powder at room temperature without heating the die or the metal powder. The die used was the same as those of the examples and the compacting pressure was also the same as those of the examples. Thus obtained was Comparative Example 2.

Comparative Example 3

Similarly, for comparison with the inner lubricant added to the metal powder, employed was metal powder added by 0.8% by weight of zinc stearate (ZnSt) powder instead of 0.3% by weight of lithium stearate powder added as an inner lubricant.

No lubricant was applied to the inner die surface. A powder compact was formed by compacting the metal powder at room temperature without heating the die or the metal powder. The die used was the same as those of the examples and the compacting pressure was also the same as those of the examples. Thus obtained was Comparative Example 3.

Table 2 shows the ejecting pressure and the green density of Examples 1 to 4 and Comparative Examples 1 to 3.

TABLE 2

| | LUBRICANT | COMPACTION TEMPERATURE | EJECTING PRESSURE (MPa) | GREEN DENSITY (g/cm$^3$) |
|---|---|---|---|---|
| Ex. 1 | No. 1 | 150° C. | 8.0 | 7.37 |
| Ex. 2 | No. 2 | 150° C. | 7.3 | 7.37 |
| Ex. 3 | No. 3 | 150° C. | 7.5 | 7.37 |
| Ex. 4 | No. 4 | 150° C. | 9.0 | 7.37 |
| Comp. Ex. 1 | U-NONS | 150° C. | 11.9 | 7.36 |
| Comp. Ex. 2 | LiSt | room temp. | 14.2 | 7.15 |
| Comp. Ex. 3 | ZnSt | room temp. | 16.2 | 7.20 |

As apparent from Table 2, all of Examples 1 to 4 had remarkably lower ejecting pressures and higher green densities than those of Comparative Examples 2 and 3 which were compacted at room temperature. Examples 1 to 4 also had remarkably lower ejecting pressures than that of Comparative Example 1 which was compacted after applying the commercial lubricant (U-NONS) to the inner die surface.

Moreover, Examples 1 to 4 had excellent compact surfaces. In contrast, Comparative Example 1 had a dark-color compact surface. Comparative Example 3 had galling on a part of the compact and a poor compact surface.

Evaluation Tests

The following evaluation tests were carried out to examine the relationship between the compacting pressure and the ejecting pressure and the relationship between the compacting pressure and the green density.

Evaluation Test 1

An evaluation test was carried out for evaluating the relationship between the compacting pressure and the ejecting pressure and the relationship between the compacting pressure and the green density. Metal powder was compacted under pressures of 393 MPa, 490 MPa, 588 MPa, 686 MPa, 785 MPa, 883 MPa and 981 MPa, and the ejecting pressure and the green density were measured with respect to each compacting pressure.

A die used was the same as those used in the above (Formation of Powder Compacts) of the [Preferred Embodiments]. All dies used in the following evaluation tests were the same as those used in the above (Formation of Powder Compacts) of the [Preferred Embodiments]. Namely, the die used had an inner diameter of 17 mm and was formed of cemented carbide. Its inner surface had been finished with TiN coating treatment and had a surface roughness of 0.4 Z according to ten points average roughness (JIS B0601).

As a lubricant applied to the inner surface of the die, employed was lithium stearate (LiSt) of No. 2 produced in the above (Preparation of Higher Fatty Acid Lubricants) of the [Preferred Embodiments]. It is to be noted that lithium stearate applied to the inner die surface in the following evaluation tests was this lithium stearate of No. 2. Application of the lubricant to the inner die surface was carried out by spraying the lubricant to the die heated to compaction temperature. The same application was also carried out in the following evaluation tests.

The metal powder heated to 150° C. was filled into the die heated to 150° C. In the following description, the die temperature and the temperature of metal powder to be charged are called 'compaction temperature'.

The metal powder used was the same as that used in the above (Formation of Powder Compacts) of the [Preferred Embodiments]. Namely, it was metal powder prepared by adding graphite powder and lithium stearate powder as an inner lubricant to alloy steel powder KIP103V produced by Kawasaki Steel Corporation and rotating them for mixing for one hour. The amount of graphite powder added was 0.5% by weight and the amount of lithium stearate powder added was 0.3% by weight based on 100% by weight of the total weight of the metal powder.

For comparison, U-NONS used in Comparative Example 1 of the above (Formation of Powder Compacts) was employed as a lubricant applied to the inner die surface. Metal powder used was also the same as those used in the examples of (Formation of Powder Compacts).

In addition, for comparison, employed as metal powder was warm compaction powder 'Densmix' which was produced by Hoganas Corporation and prepared by adding 0.8% by weight of graphite (C) and 0.6% by weight of a lubricant to Astaloy 85Mo based on 100% by weight of the total weight of the metal powder. Since this metal powder contained a lubricant, no lubricant was applied to the inner die surface.

Figure 4:
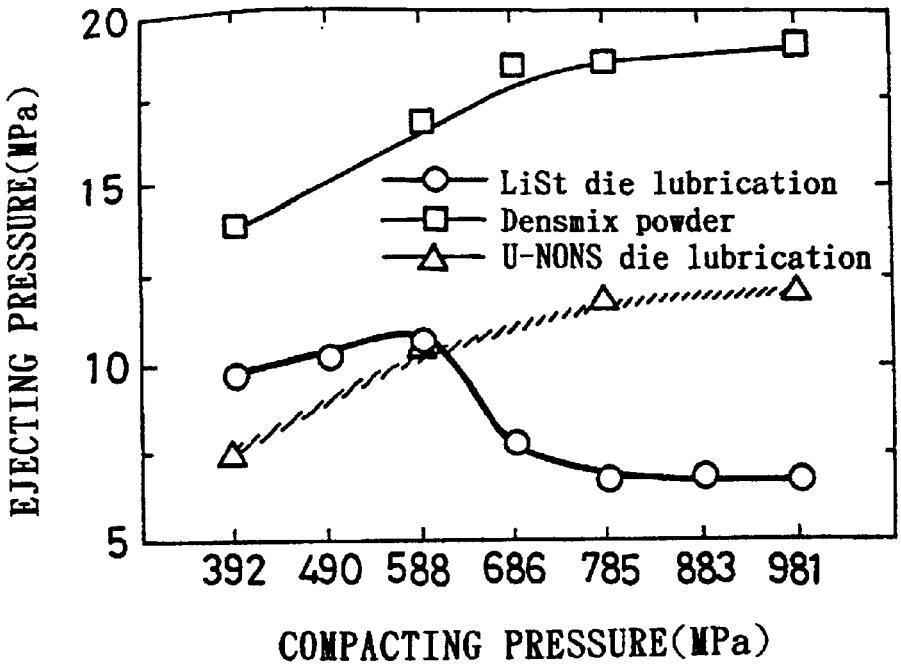
FIG. 4 is a graph showing the relationship between compacting pressure and ejecting pressure in Evaluation Test 1.

FIG. 4 shows the relationship between the compacting pressure and the ejecting pressure of three cases: In the case of LiSt die lubrication, lithium stearate was applied to the inner die surface and the above metal powder was employed which was prepared by adding graphite powder and lithium stearate powder to the alloy steel powder KIP103V. In the case of U-NONS die lubrication, U-NONS was applied to the inner die surface and the same metal powder was employed which was prepared by adding graphite powder and lithium stearate powder to the alloy steel powder KIP103V. In the case of Densmix powder, no lubricant was applied to the inner die surface and Densmix was employed as metal powder. When lithium stearate was applied to the inner die surface, pressures for ejecting compacts formed under the above pressures are shown. In the meanwhile, when U-NONS was applied, pressures for ejecting compacts formed under pressures of 392 MPa, 588 MPa, 785 MPa, and 981 MPa are shown. When Densmix was employed as metal powder, pressures for ejecting compacts formed under pressures of 392 MPa, 588 MPa, 686 MPa, 785 MPa and 981 MPa are shown.

When Densmix was employed as metal powder, the ejecting pressure increased in accordance with an increase in the compacting pressure. When U-NONS was applied to the die inner surface, the ejecting pressure increased in accordance with an increase in the compacting pressure, although the rate of increase in the ejecting pressure was smaller than that in the case of Densmix.

In contrast, when lithium stearate was applied to the inner die surface, the ejecting pressure increased until the compacting pressure reached 588 MPa, but when the compacting pressure became 686 MPa or more, the ejecting pressure decreased contrarily: This ejecting pressure was remarkably lower than those in the case where U-NONS was applied and in the case where Densmix was employed as metal powder. This is the largest feature of the method of forming a powder compact of the present invention.

Although not shown as data, when lithium stearate was applied to the inner die surface, the surface condition of the compact was excellent. In contrast, when Densmix was applied as metal powder, galling was observed on the surface of the compact and a compact with a satisfactory surface cannot be obtained.

Figure 5:
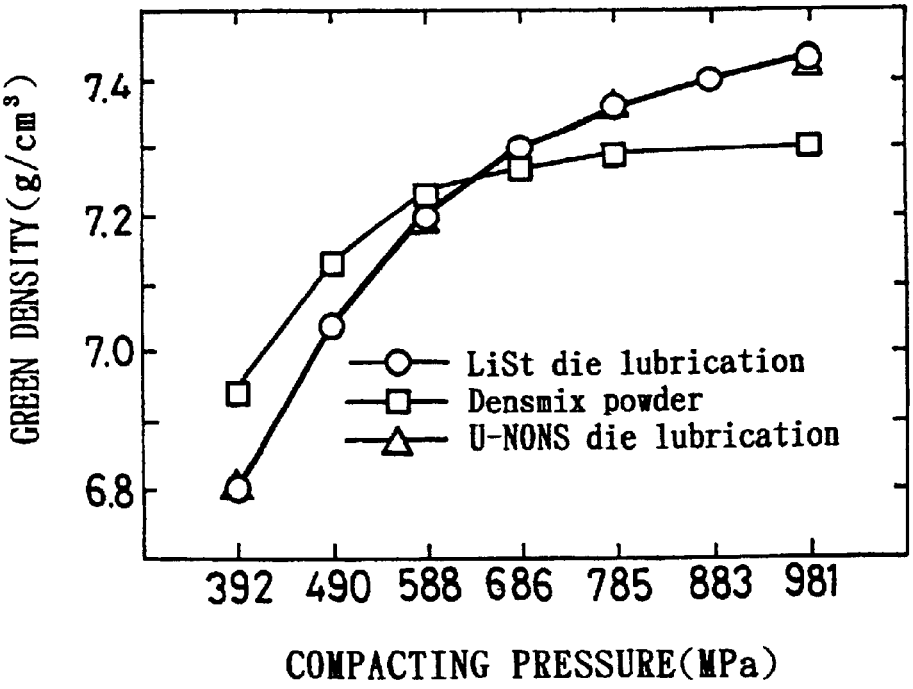
FIG. 5 is a graph showing the relationship between compacting pressure and green density in Evaluation Test 1.

FIG. 5 shows the relationship between the compacting pressure and the green density of three cases. In the case of LiSt die lubrication, lithium stearate was applied to the inner die surface and the above metal powder was employed which was prepared by adding graphite powder and lithium stearate powder to the alloy steel powder KIP103V. In the case of U-NONS die lubrication, U-NONS was applied to the inner die surface and the same metal powder was employed which was prepared by adding graphite powder and lithium stearate powder to the alloy steel powder KIP103V. In the case of Densmix powder, no lubricant was applied to the die surface and Densmix was employed as metal powder. When lithium stearate was applied, density of compacts formed under the above pressures are shown. In the meanwhile, when U-NONS was applied, density of compacts formed under pressures of 392 MPa, 588 MPa and 785 MPa are shown. When Densmix was employed as metal powder, density of compacts formed under pressures of 392 MPa, 490 MPa, 588 MPa, 686 MPa, 785 MPa and 981 MPa are shown.

As the compacting pressure was higher, the green density was higher. The green densities in the cases where lithium stearate or U-NONS was applied to the inner die surface were almost the same and as high as not less than 7.4 $cm^3$. However, when Densmix was employed as metal powder, the green density was smaller than 7.3 $g/cm^3$.

Evaluation Test 2

An evaluation test was carried out for examining the relationship between the compacting pressure and the ejecting pressure and the relationship between the compacting pressure and the green density under conditions in which the compact temperature was set at 105° C., 125° C. and 150° C. and lithium stearate was applied as a lubricant to the inner die surface.

Pure iron powder ASC100-29 produced by Hoganas Corporation was employed as metal powder. No inner lubricant was employed. That is to say, this evaluation test was carried out by employing only pure iron powder as metal powder.

The metal powder was compacted under compacting pressures of 393 MPa, 490 MPa, 588 MPa, 686 MPa, 785 MPa and 981 MPa, and the ejecting pressure and the compact density were measured with respect to each compacting pressure. It is to be noted that at 150° C. another compact was formed under a compacting pressure of 1176 MPa and the ejecting pressure and the green density were also measured about the compact.

Figure 6:
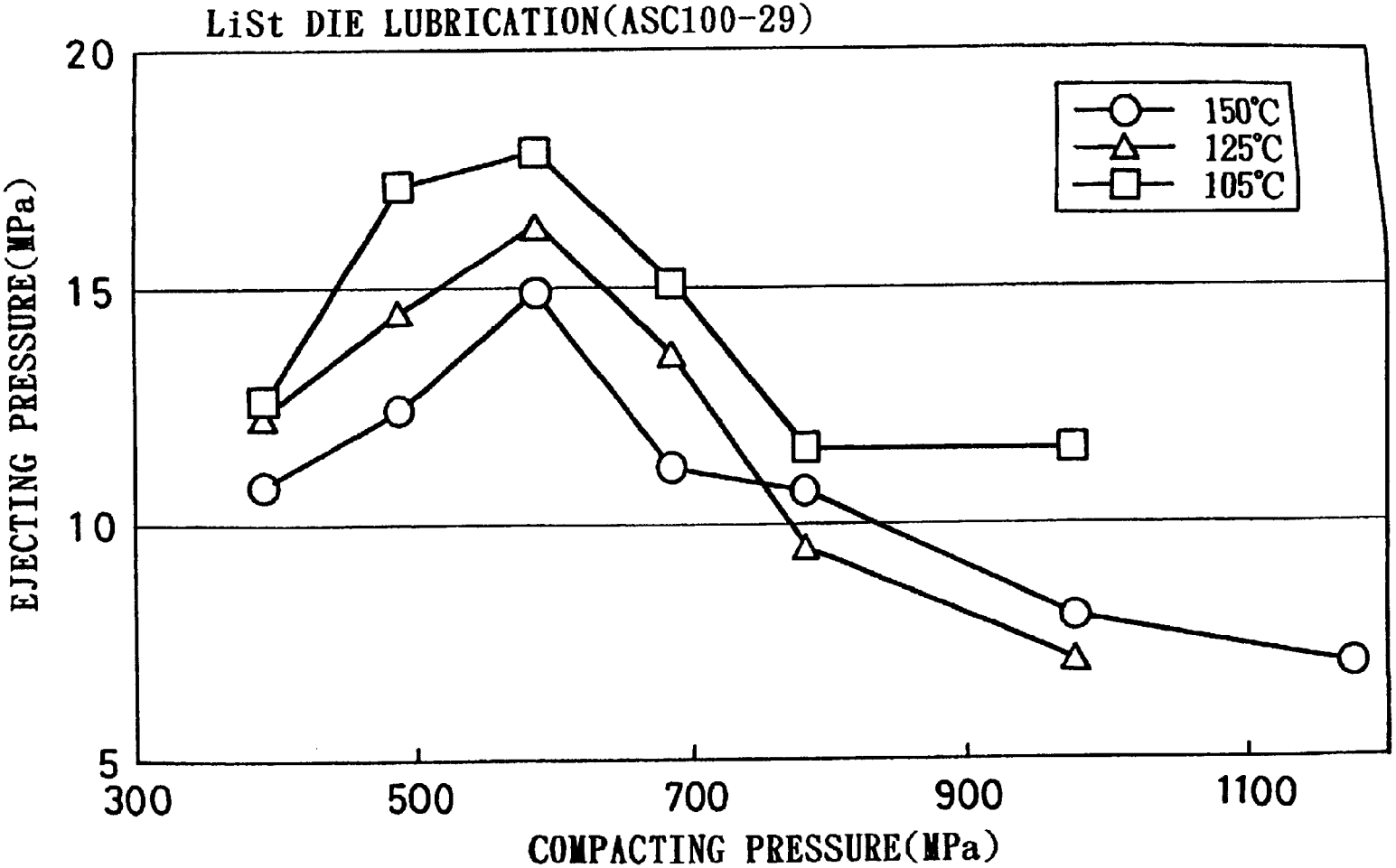
FIG. 6 is a graph showing the relationship between compacting pressure and ejecting pressure in Evaluation Test 2.

FIG. 6 shows the relationship between the compacting pressure and the ejecting pressure at the respective temperatures. At each of the temperatures 105° C., 125° C. and 150° C., the ejecting pressure was the maximum when compaction was carried out under 586 MPa. When the compacting pressure was 686 MPa or more, the ejecting pressure decreased contrarily.

Figure 7:
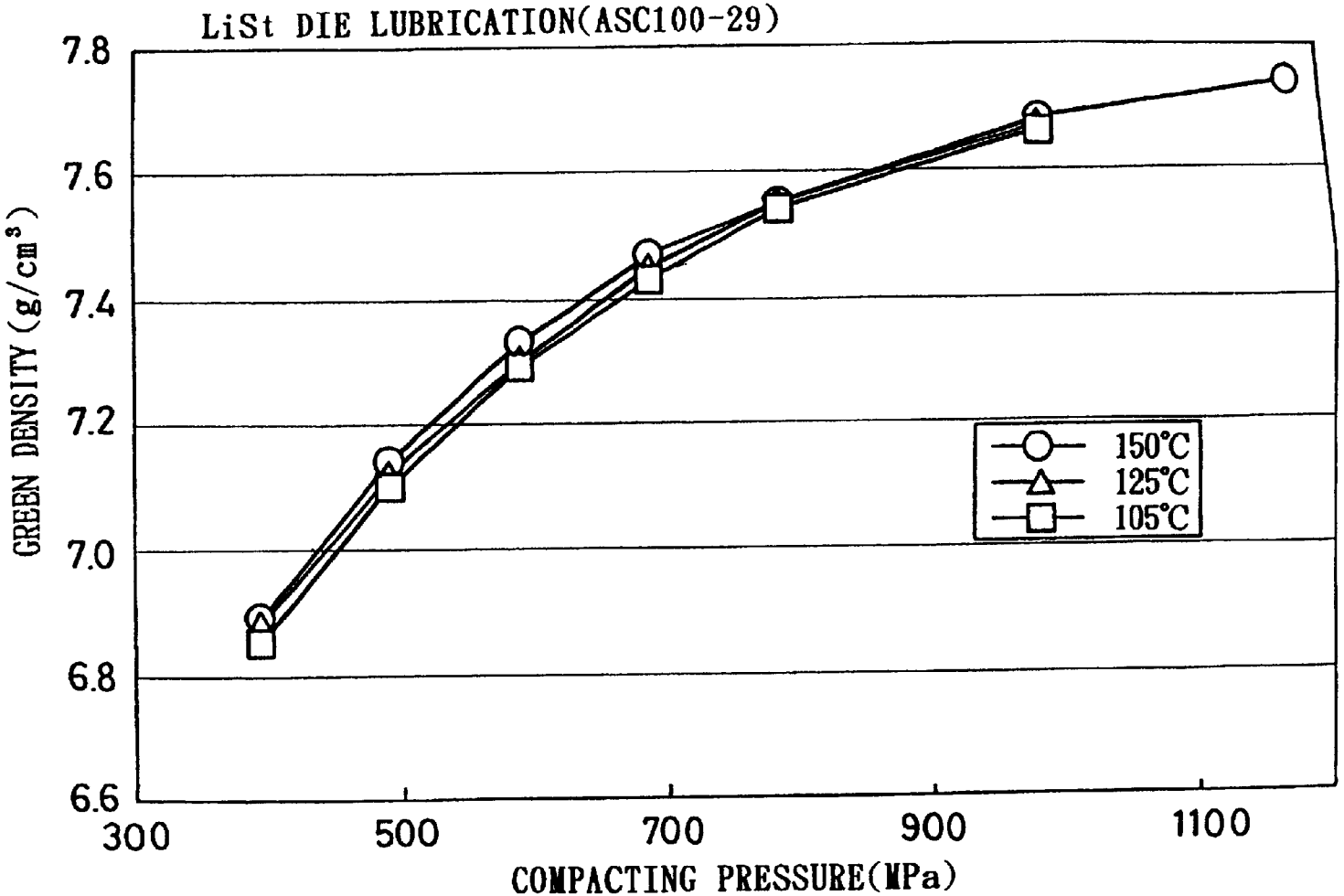
FIG. 7 is a graph showing the relationship between compacting pressure and green density in Evaluation Test 2.

FIG. 7 shows the relationship between the compacting pressure and the green density at the respective temperatures. At each of the temperatures 105° C., 125° C. and 150° C., as the compacting pressure was higher, the green density was higher.

It is apparent from FIGS. 6 and 7 that when compacts are formed under a pressure of 686 MPa or more while lithium stearate is used as a lubricant applied to a die, the ejecting pressure decreases and at the same time a high density compact can be obtained.

Evaluation Test 3

An evaluation test was carried out for examining the relationship between the compacting pressure and the ejecting pressure and the relationship between the compacting pressure and the green density in the case where the compaction temperature was set at 105° C. and lithium stearate, calcium stearate or zinc stearate was applied as a lubricant to the inner die surface.

The calcium stearate and zinc stearate used were prepared by the same method as those of No. 2 of (Preparation of Higher Fatty Acid Lubricants) of the above [Preferred Embodiments]. It is to be noted that calcium stearate and zinc stearate applied to the inner die surface in the following evaluation tests were similarly prepared.

Metal powder used was pure iron powder ASC100-29 produced by Hoganas Corporation. No inner lubricant was used. Namely, this evaluation test was carried out by employing only pure iron powder as metal powder.

The ejecting pressure and the green density were measured about compacts formed under compacting pressures of 393 MPa, 490 MPa, 588 MPa, 686 MPa, 785 MPa and 981 MPa.

Figure 8:
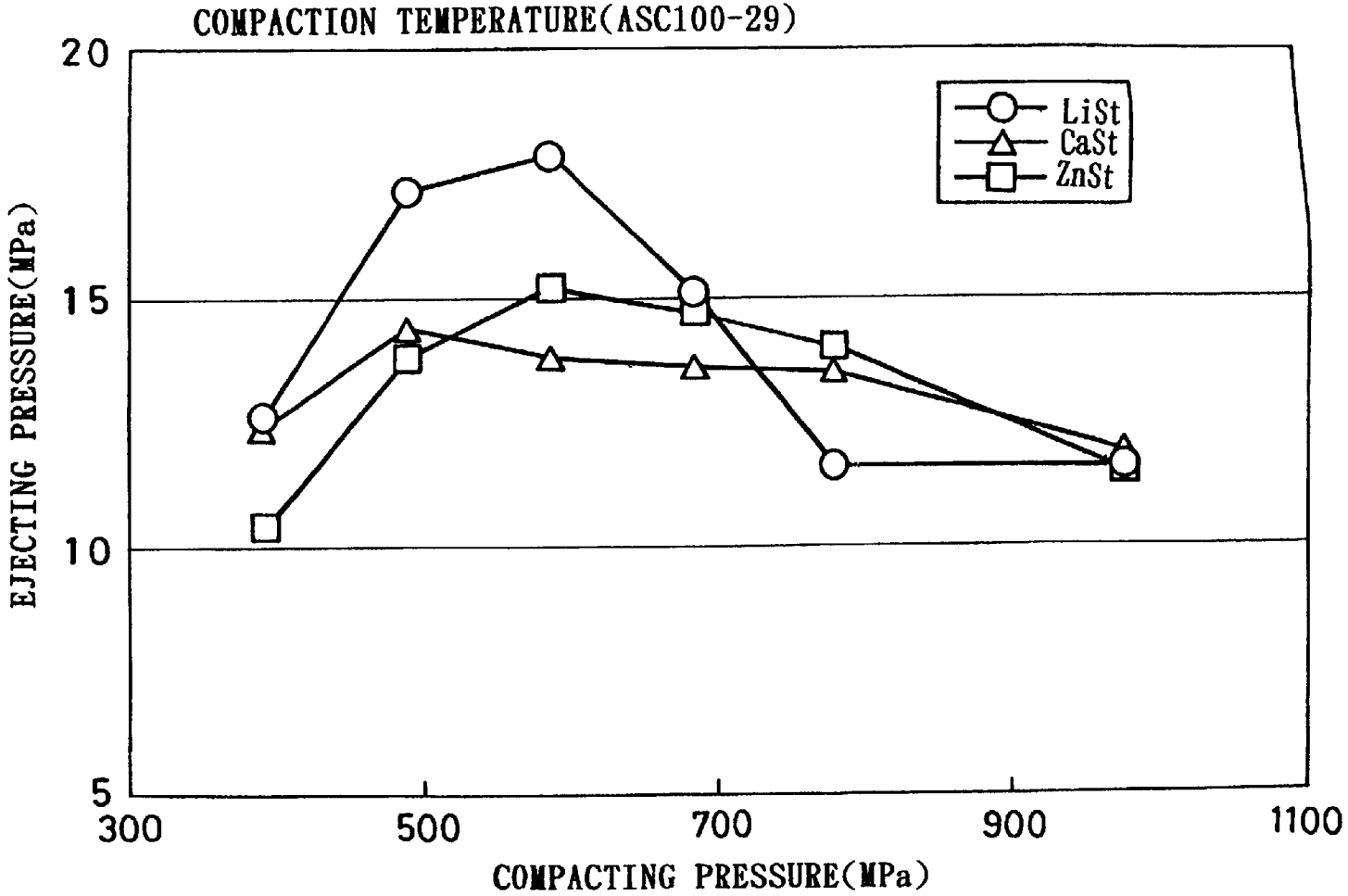
FIG. 8 is a graph showing the relationship between compacting pressure and ejecting pressure in Evaluation Test 3.

FIG. 8 shows the relationship between the compacting pressure and the ejecting pressure when lithium stearate (LiSt), calcium stearate (CaSt) or zinc stearate (ZnSt) was employed. In the case of lithium stearate and zinc stearate, the ejecting pressure was the maximum when the compacting pressure was 588 MPa. When the compacting pressure was 686 MPa or more, the ejecting pressure decreased. In the case of calcium stearate, the ejecting pressure was the maximum when the compacting pressure was 490 MPa. When the compacting pressure was 588 MPa or more, the ejecting pressure decreased.

Figure 9:
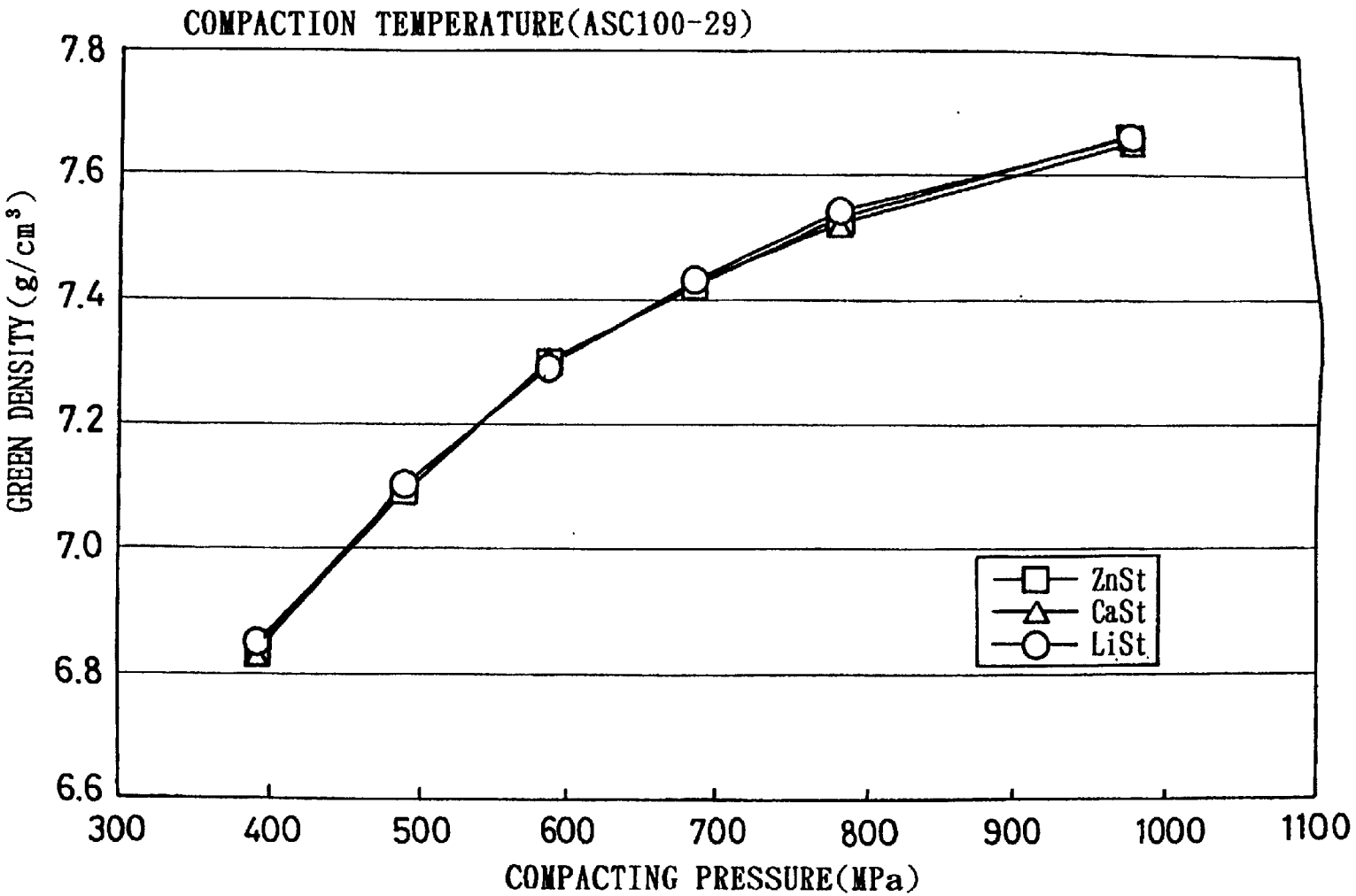
FIG. 9 is a graph showing the relationship between compacting pressure and green density in Evaluation Test 3.

FIG. 9 shows the relationship between the compacting pressure and the green density when lithium stearate (LiSt), calcium stearate (CaSt) or zinc stearate (ZnSt) was employed. The relationships were almost the same despite the kind of lubricants used: As the compacting pressure was higher, the green density was higher.

Evaluation Test 4

An evaluation test was carried out for examining the relationship between the compacting pressure and the ejecting pressure and the relationship between the compacting pressure and the green density in the case where the compaction temperature was set at 125° C. and lithium stearate and calcium stearate were respectively applied as a lubricant to the inner die surface.

Lithium stearate and calcium stearate employed were the same as those of Evaluation Test 3. Metal powder employed was the same as that of Evaluation Test 3, i.e., pure iron powder ASC100-29 produced by Hoganas Corporation. No inner lubricant was employed. Namely, this evaluation test was carried out by employing only pure iron powder as metal powder.

Compaction was carried out under compacting pressures of 393 MPa, 490 MPa, 588 MPa, 686 MPa, 785 MPa and 981 MPa, and the ejecting pressure and the green density were measured with respect to each compacting pressure.

Figure 10:
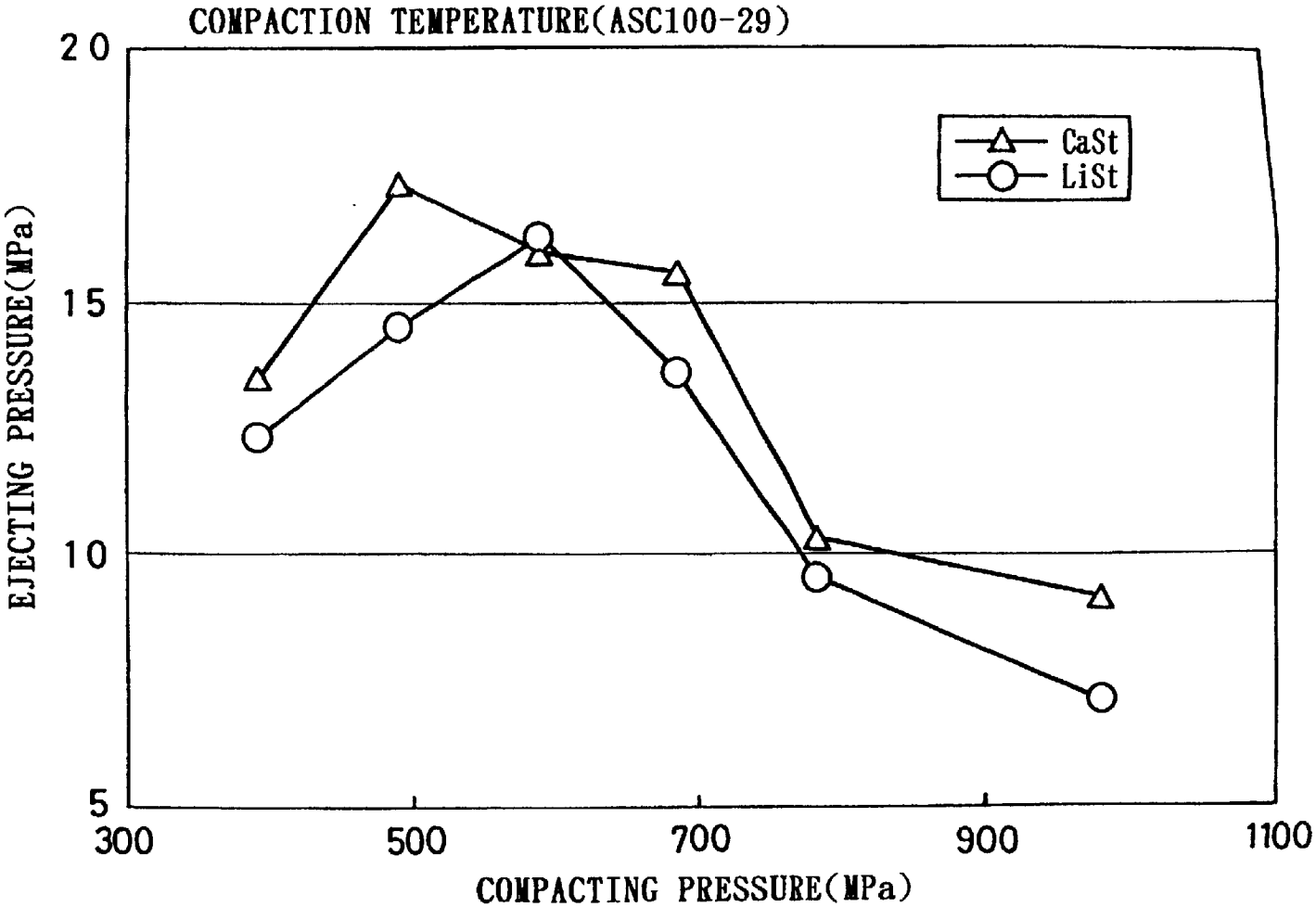
FIG. 10 is a graph showing the relationship between compacting pressure and ejecting pressure in Evaluation Test 4.

FIG. 10 shows the relationship between the compacting pressure and the ejecting pressure in the case where lithium stearate (LiSt) or calcium stearate (CaSt) was employed. In the case of lithium stearate, the ejecting pressure was the maximum when the compacting pressure was 588 MPa. When the compacting pressure was 686 MPa or more, the ejecting pressure decreased. In the case of calcium stearate, the ejecting pressure was the maximum when the compacting pressure was 490 MPa. When the compacting pressure was 588 MPa or more, the ejecting pressure decreased.

Figure 11:
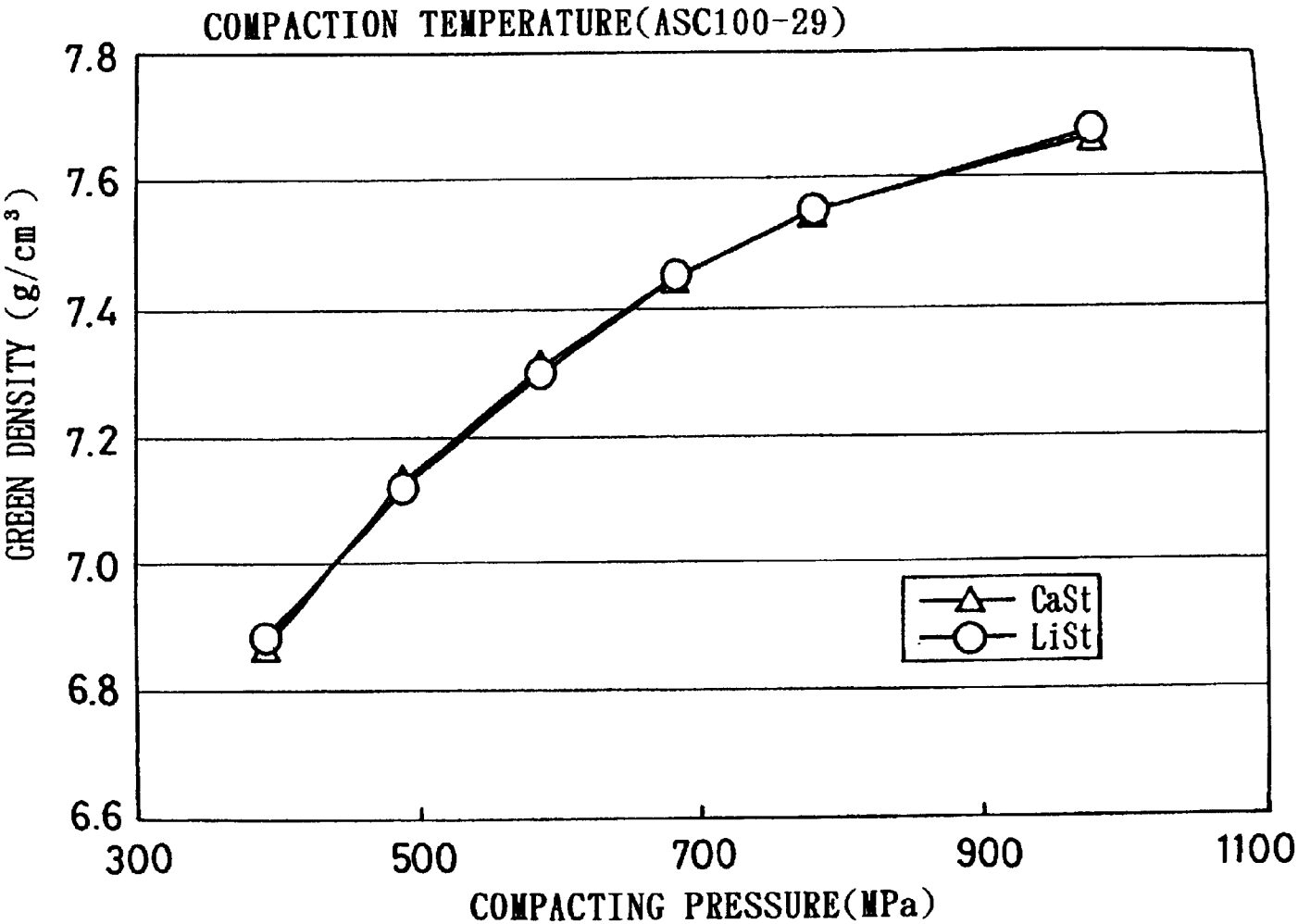
FIG. 11 is a graph showing the relationship between compacting pressure and green density in Evaluation Test 4.

FIG. 11 shows the relationship between the compacting pressure and the green density in the case where lithium stearate or calcium stearate was employed. In either case, the relationships were almost the same: As the compacting pressure was higher, the green density was higher.

As apparent from Evaluation Tests 3 and 4, when any of lithium stearate, calcium stearate and zinc stearate was employed as a lubricant applied to the inner die surface, compaction at a certain compaction temperature and with a certain pressure or more allows the ejecting pressure to decrease and a compact with a high green density to be obtained.

Evaluation Test 5

An evaluation test was carried out for examining the relationship between the compacting pressure and the ejecting pressure and the relationship between the compacting pressure and the green density in the case where the compaction temperature was set at 150° C. and lithium stearate was applied as a lubricant to the inner die surface and graphite was added to iron powder.

The metal powder used in this evaluation test was all based on iron powder ASC100-29 produced by Hoganas Corporation and of three kinds: metal powder composed of only this iron powder, metal powder prepared by adding 0.5% by weight of graphite (C) to this iron powder, and metal powder prepared by adding 1% by weight of graphite (C) to this iron powder, based on 100% by weight of the total weight of the metal powder. Compaction was carried out under compacting pressures of 588 MPa, 785 MPa and 981 MPa, and the ejecting pressure and the compact density were measured with respect to each compacting pressure.

Figure 12:
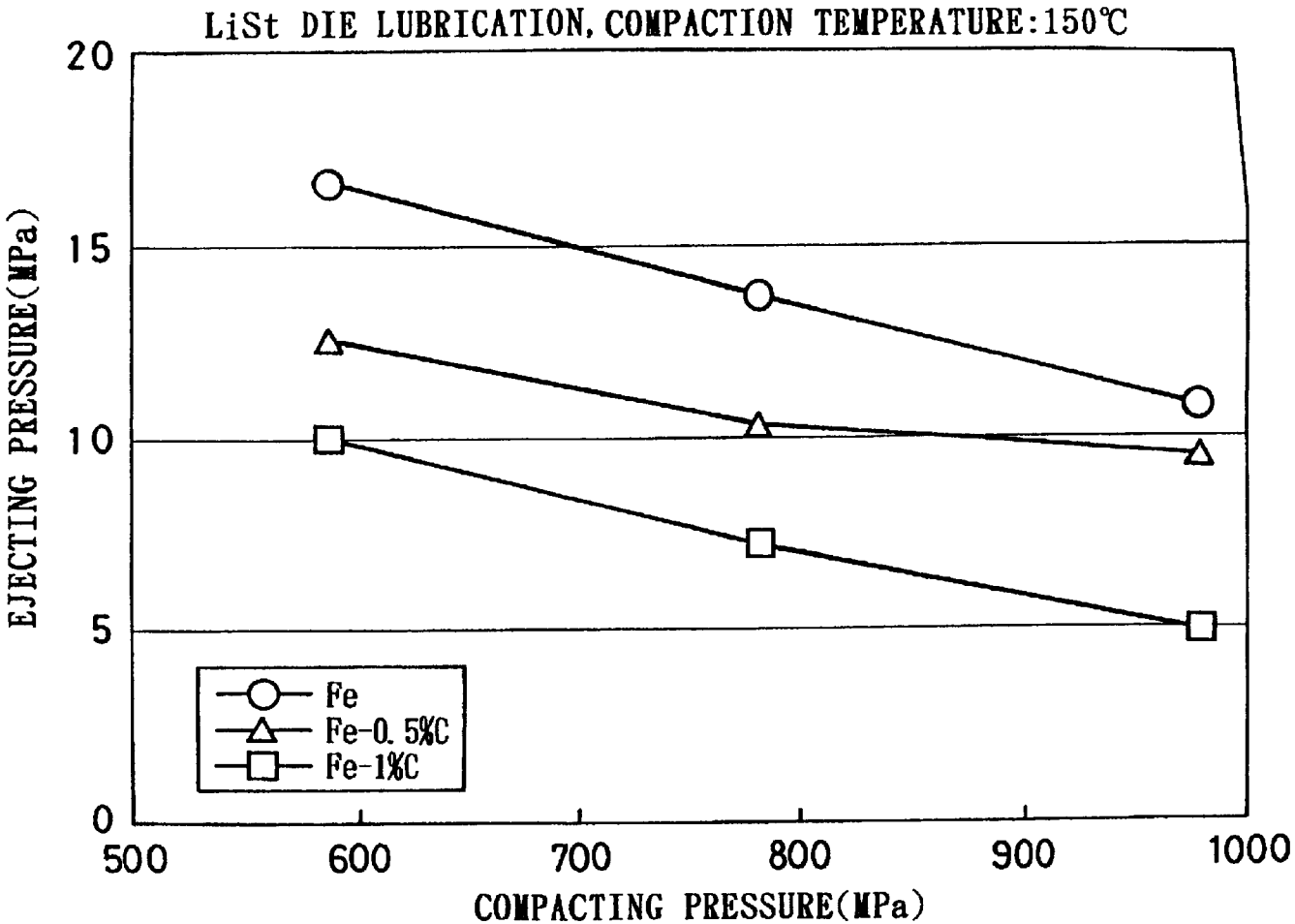
FIG. 12 is a graph showing the relationship between compacting pressure and ejecting pressure in Evaluation Test 5.

FIG. 12 shows the relationship between the compacting pressure and the ejecting pressure in the case where the metal powder used was iron powder alone (Fe), iron powder added by 0.5% by weight of graphite (Fe-0.5% C) and iron powder added by 1% by weight of graphite (Fe-1% C). In each case, the ejecting pressure decreased despite an increase in the compacting pressure. The ejecting pressure in the case of iron powder alone was higher than that in the case of iron powder added by graphite. When graphite was added to iron powder, the ejecting pressure in the case of 0.5% by weight addition was higher than that in the case of 1% by weight addition.

Figure 13:
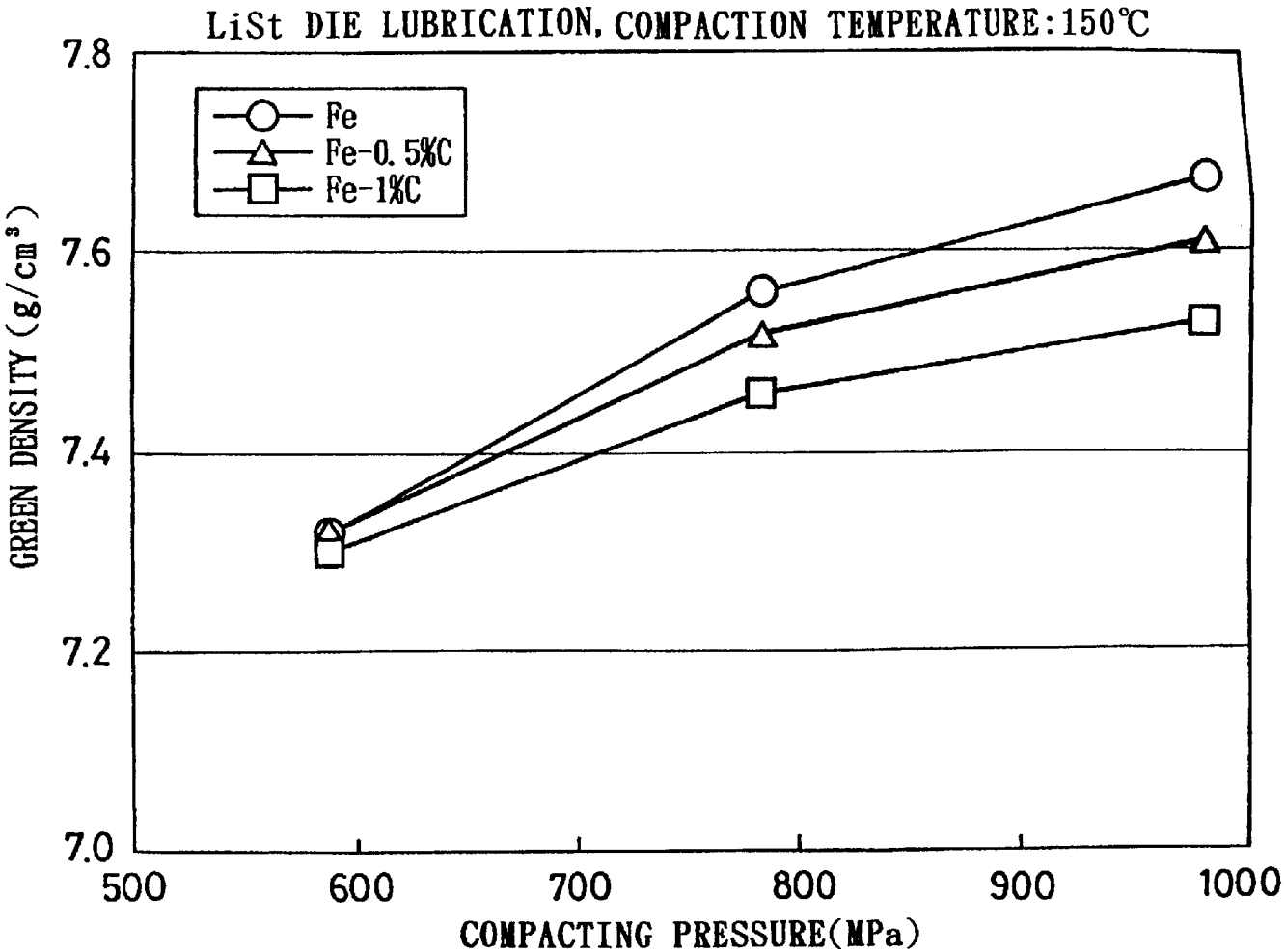
FIG. 13 is a graph showing the relationship between compacting pressure and green density in Evaluation Test 5.

FIG. 13 shows the relationship between the compacting pressure and the green density in the case where the metal powder was iron powder alone (Fe), iron powder added by 0.5% by weight of graphite (Fe-0.5% C), and iron powder added by 1% by weight of graphite (Fe-1% C). In each case, as the compacting pressure was higher, the green density was higher. The green density in the case of iron powder alone was higher than that in the case of iron powder added by graphite. When graphite was added, the green density in the case of 0.5% by weight addition was higher than that in the case of 1% by weight addition.

The foregoing test showed that as graphite is added to iron powder in a larger amount, the ejecting pressure decreased more but the green density becomes smaller. Because graphite addition decreases apparent true density, respective density ratios are almost the same.

Evaluation Test 6

An evaluation test was carried out for examining the relationship between the compacting pressure and the ejecting pressure and the relationship between the compacting pressure and the green density in the case where the compaction temperature was set at room temperature and no lubricant was applied to the inner die surface and an inner lubricant was added to metal powder.

Metal powder employed was prepared by using alloy steel powder KIP103V produced by Kawasaki Steel Corporation as iron powder and adding 0.5% by weight of graphite (C) and 0.8% by weight of inner lubricant to this iron powder (103V-0.5% C+0.8% Lub.) based on 100% by weight of the total weight of the metal powder. The inner lubricant used was lithium stearate, zinc stearate or calcium stearate.

In the case of employing each of three inner lubricants, compaction was carried out with compacting pressures of 393 MPa, 490 MPa, 588 MPa, 686 MPa, 785 MPa and 981 MPa and the ejecting pressure and the green density were respectively measured with respect to each compacting pressure.

Figure 14:
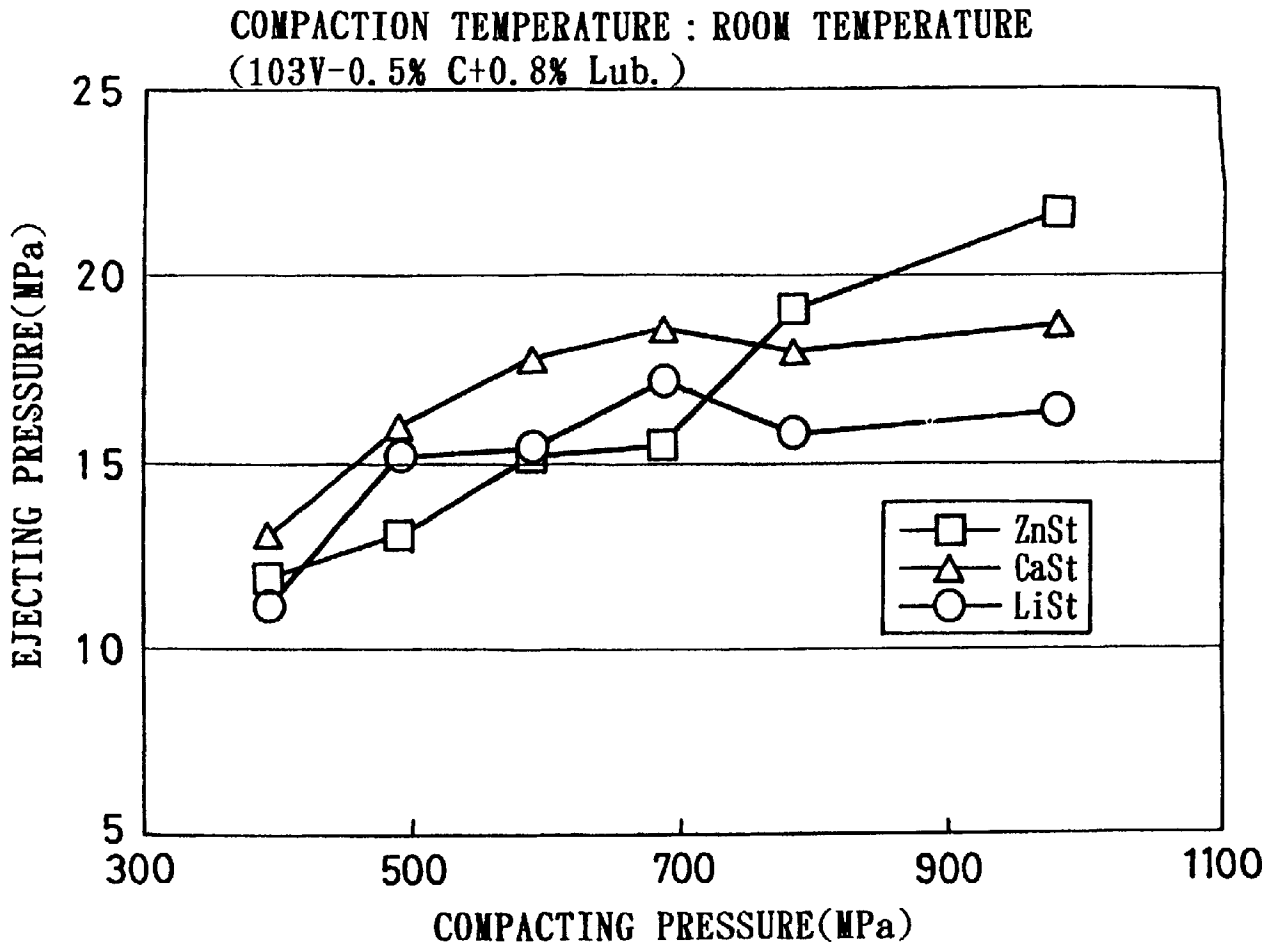
FIG. 14 is a graph showing the relationship between compacting pressure and ejecting pressure in Evaluation Test 6.

FIG. 14 shows the relationship between the compacting pressure and the ejecting pressure in the case where lithium stearate (LiSt), zinc stearate (ZnSt) or calcium stearate (CaSt) was employed as an inner lubricant. In the case of zinc stearate, as the compacting pressure was higher, the ejecting pressure was higher. In the case of lithium stearate, the ejecting pressure was the maximum when the compacting pressure was 686 MPa and the ejecting pressure decreased when the compacting pressure was 785 MPa, but the ejecting pressure increased again when the compacting pressure was 981 MPa. The remarkable decrease in the ejecting pressure as in Evaluation Tests 2, 3 or 4 in which a lubricant was applied to an inner surface of a heated die was not observed. In the case of calcium stearate, the ejecting pressure slightly decreased when the compacting pressure was 785 MPa, but the ejecting pressure increased again when the compacting pressure was 981 MPa. Remarkable decreases in the ejecting pressure as in Evaluation Tests 2, 3, 4 in which a lubricant was applied to an inner surface of a heated die were not observed.

Figure 15:
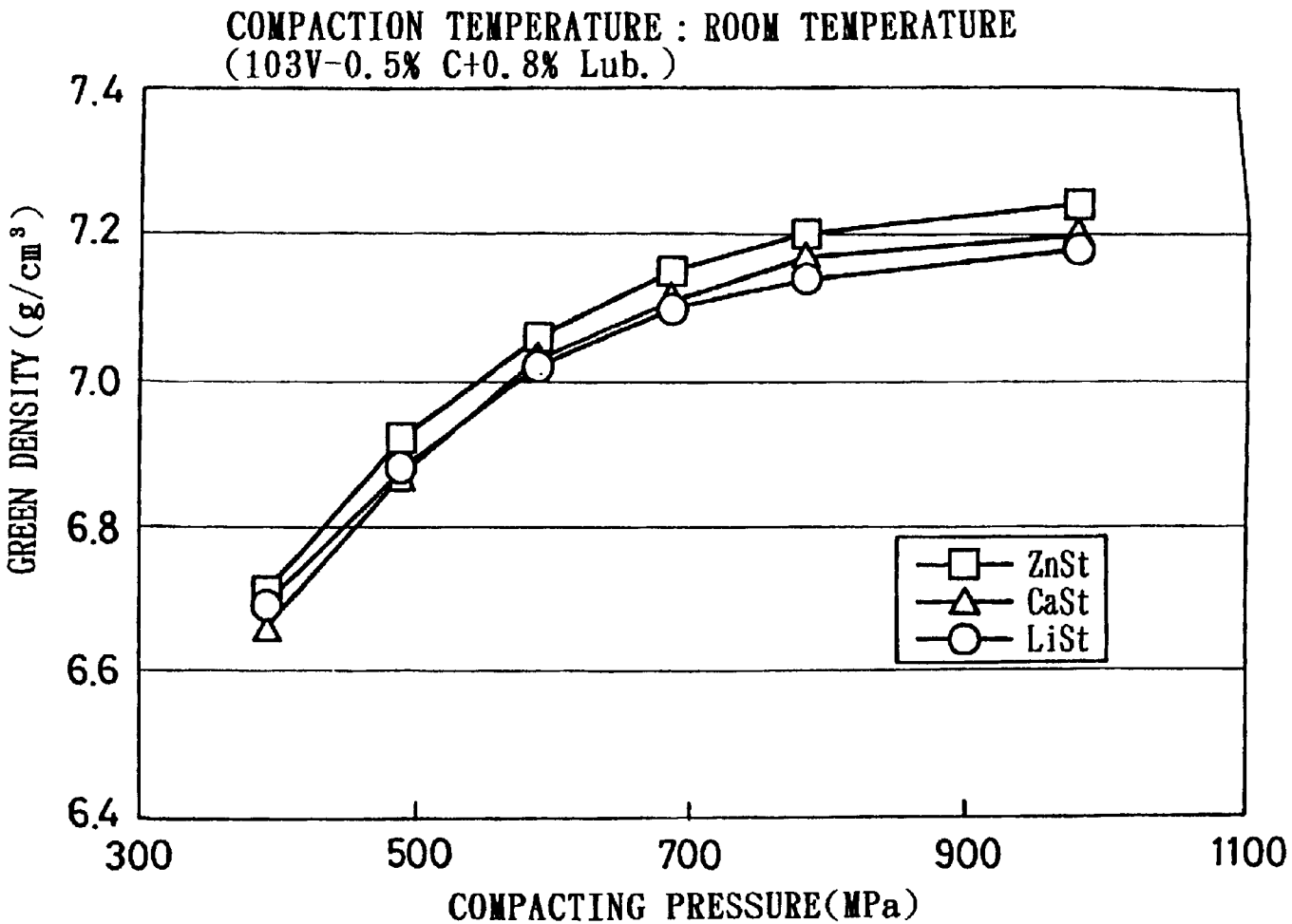
FIG. 15 is a graph showing the relationship between compacting pressure and green density in Evaluation Test 6.

FIG. 15 shows the relationship between the compacting pressure and the green density in the case where lithium stearate (LiSt), zinc stearate (ZnSt) or calcium stearate (CaSt) was employed as an inner lubricant. In each case, as the compacting pressure was higher, the green density was higher. However, the green density was lower than those of Evaluation Tests 2, 3 and 4. It is assumed that it is effective to increase the green density to decrease the amount of inner lubricant added and give heat.

Evaluation Test 7

An evaluation test was carried out for examining the relationship between the compacting pressure and the ejecting pressure in the case where the compaction temperature was set at 150° C. and no lubricant was applied in one hand and lithium stearate was applied on the other hand to the inner die surface.

When no lubricant was applied to the inner die surface, warm compaction powder Densmix was employed which was produced by Hoganas Corporation and prepared by adding 0.8% by weight of graphite and 0.6% by weight of lubricant to Astaloy 85 Mo based on 100% by weight of the total weight of the metal powder. When lithium stearate was applied to the die, warm compaction powder Densmix was employed which was produced by Hoganas Corporation and prepared by adding 0.8% by weight of graphite and 0.2% by weight of lubricant to Astaloy85Mo based on 100% by weight of the total weight of the metal powder. Compaction was carried out with compacting pressures of 490 MPa, 588 MPa, 686 MPa, 785 MPa, and 981 MPa, and the ejecting pressure was measured with respect to each compacting pressure.

Figure 16:
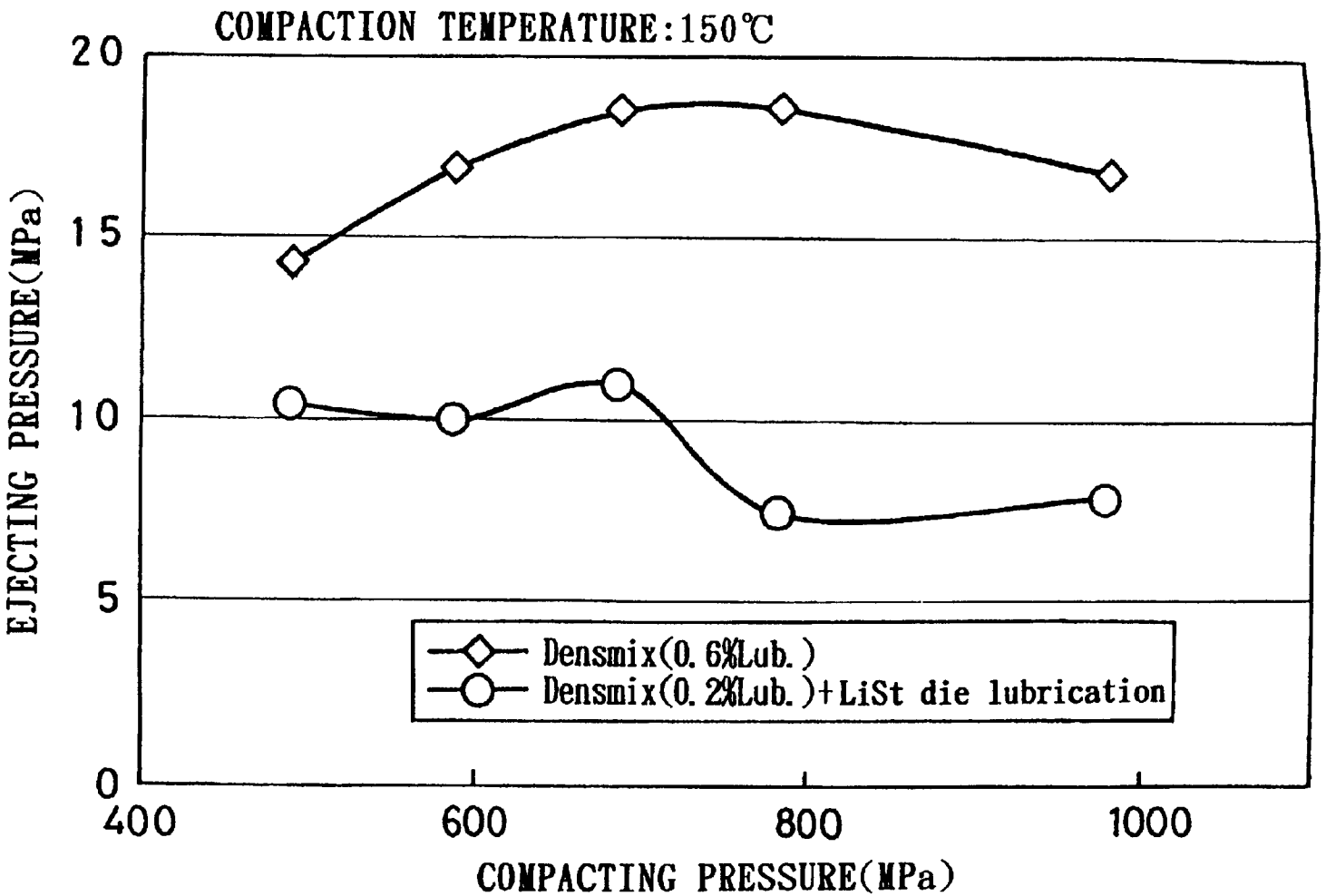
FIG. 16 is a graph showing the relationship between compacting pressure and ejecting pressure in Evaluation Test 7.

FIG. 16 shows the relationship between the compacting pressure and the ejecting pressure in the case where lithium stearate was applied as a lubricant to the inner die surface (Densmix (0.2% Lub.)+LiSt die lubrication) and in the case where no lubricant was applied to the inner die surface (Densmix (0.6% Lub.)).

When lithium stearate was applied to the inner die surface, the ejecting pressure remarkably decreased when the compacting pressure was 785 MPa, and the ejecting pressure was almost the same when the compacting pressure was 981 MPa. The ejecting pressure in the case of applying no lubricant to the inner die surface was higher than that in the above case of applying the lubricant. Besides, as the compacting pressure was higher, the ejecting pressure was higher and when the compacting pressure was 981 MPa, the ejecting pressure only slightly decreased.

Evaluation Test 8

Figure 17:
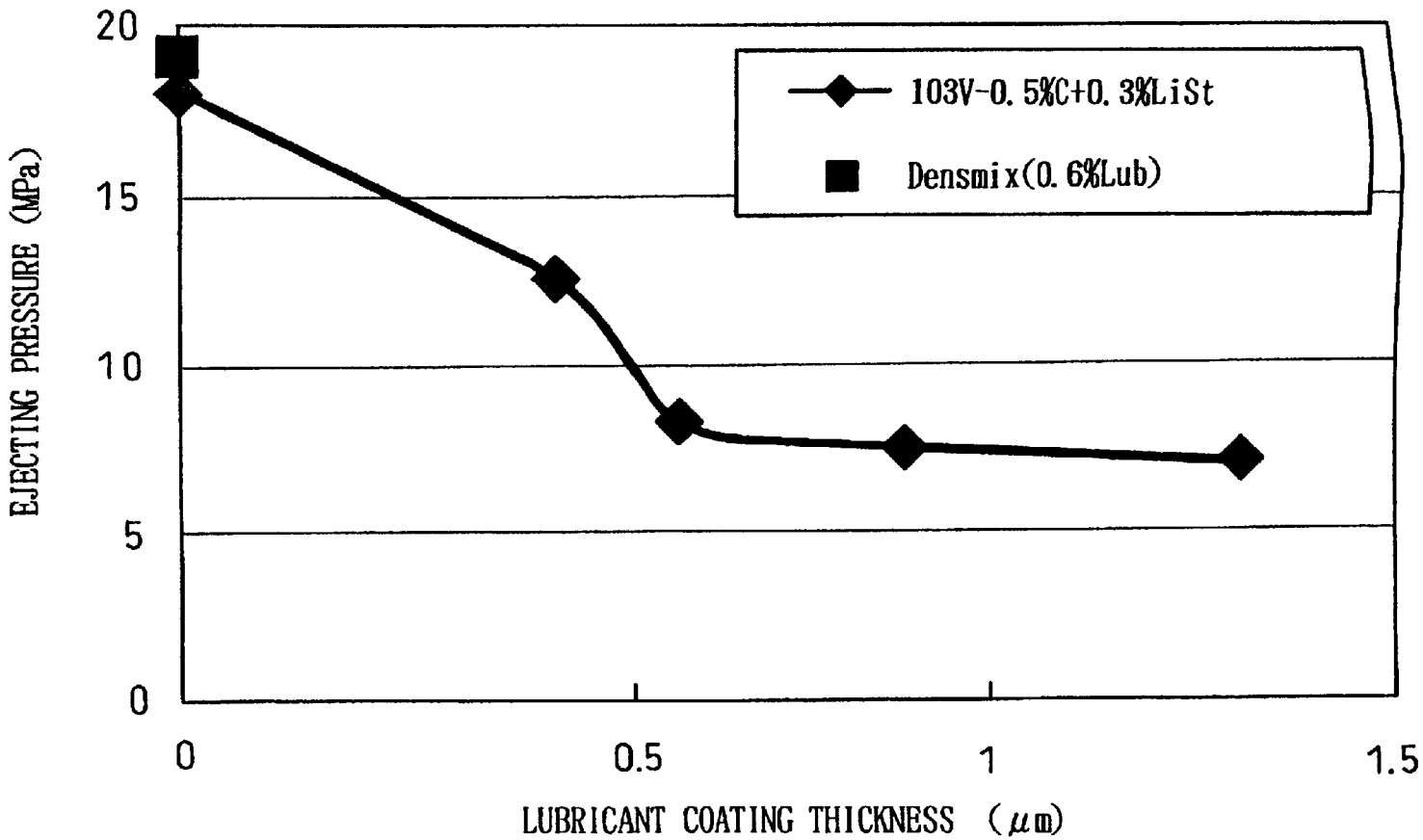
FIG. 17 is a graph showing the relationship between lubricant coating thickness and ejecting pressure in Evaluation Test 8.

FIG. 17 shows the relationship between the thickness of the lithium stearate coating on the inner die surface and the ejecting pressure. The coating thickness was controlled by varying time for spraying the lubricant by a spray gun. The coating thickness 0 means that no lubricant was applied to the die. The metal powders used here were KIP103V alloy powder added by 0.5% graphite powder and 0.3% lithium stearate powder, and warm compaction powder 'Densmix' produced by Hoganas Corporation, both used in Evaluation Test 1. Since Densmix contained 0.6% lubricant, no lubricant was applied to the die. Compaction was carried out at a die temperature of 150° C. and a compacting pressure of 784 MPa. As the lubricant coating thickness was larger, the ejecting pressure was lower. However, when the coating thickness was 0.5 μm or more, the ejecting pressure was almost constant.

Evaluation Test 9

An evaluation test was carried out for examining the relationship between the compacting pressure and the ejecting pressure and the relationship between the compacting pressure and the green density in the case where the compaction temperature was set at 150° C. and lithium stearate was applied to the inner die surface and metal powder employed was various low alloy steels which were highly practical as high strength sintering materials.

Four types of metal powders were prepared. Each of them was prepared by adding graphite powder and lithium stearate powder as an inner lubricant to low alloy steel powders. The low alloy steel powders were atomized powders KIP103V, 5 MoS and 30 CRV all produced by Kawasaki Steel Corporation. The composition of KIP103V was Fe-1 wt. % Cr-0.3 wt. % Mo-0.3 wt. % V. The composition of 5 MoS was Fe-0.6 wt. % Mo-0.2 wt. % Mn. The composition of 30 CRV was Fe-3 wt. % Cr-0.3 wt. % Mo-0.3 wt. % V.

This KIP103V was added by 0.3% by weight of graphite powder and 0.3% by weight of lithium stearate powder based on 100% by weight of the total weight of the metal powder, thereby preparing metal powder (103V-0.3% C+0.3% LiSt).

Similarly, this KIP103V was added by 0.5% by weight of graphite powder and 0.3% by weight of lithium stearate powder based on 100% of the total weight of the metal powder, thereby preparing metal powder (103V-0.5% C+0.3% LiSt).

5 MoS was added by 0.2% by weight of graphite powder and 0.3% by weight of lithium stearate powder based on 100% of the total weight of the metal powder, thereby preparing metal powder (5MoS-0.2 wt. % C+0.3 wt. % LiSt).

30 CRV was added by 1% by weight of graphite powder and 0.3% by weight of lithium stearate powder based on 100% of the total weight of the metal powder, thereby preparing metal powder (30CRV-1% C+0.3% LiSt).

These four kinds of metal powders were compacted under compacting pressures of 588 MPa, 686 MPa, 785 MPa and 981 MPa, and the ejecting pressure and the green density were measured with respect to each compacting pressure.

Figure 18:
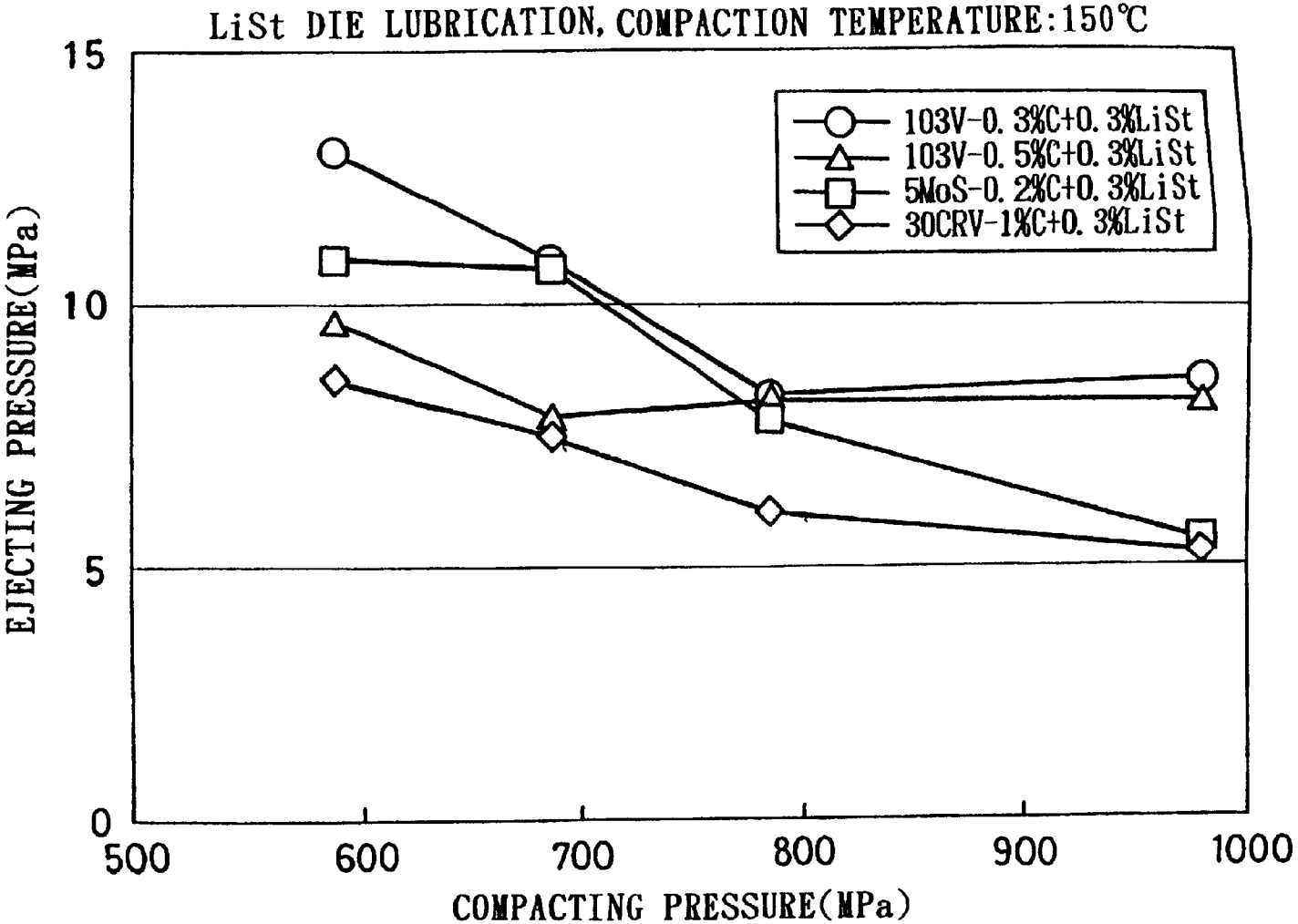
FIG. 18 is a graph showing the relationship between compacting pressure and ejecting pressure in Evaluation Test 9.
Figure 19:
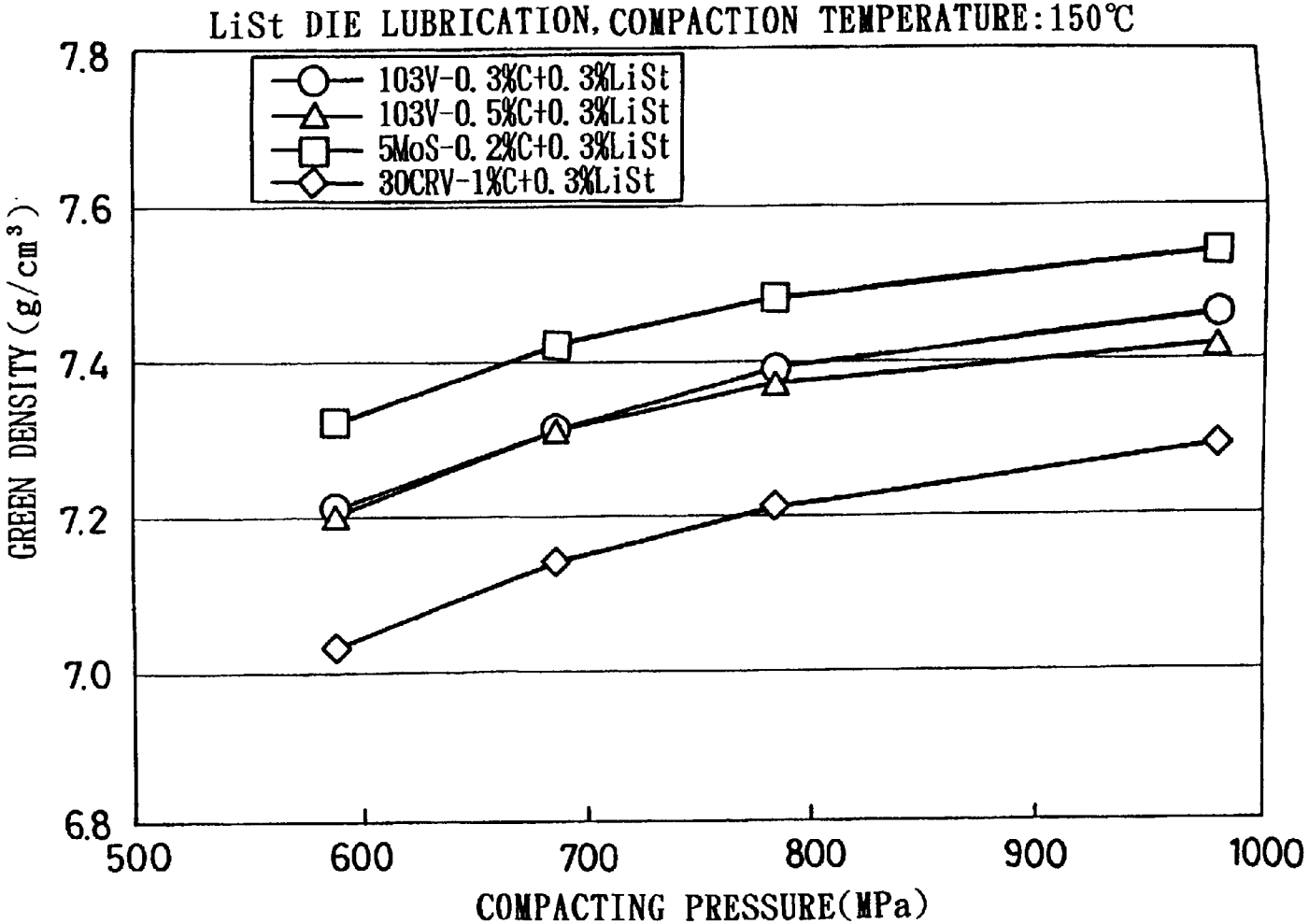
FIG. 19 is a graph showing the relationship between compacting pressure and green density in Evaluation Test 9.

FIG. 18 shows the relationship between the compacting pressure and the ejecting pressure in the case of using these four types of metal powders. FIG. 19 shows the relationship between the compacting pressure and the green density in the case of using these four types of metal powders.

As apparent from these figures, the metal powders of the respective compositions exhibited almost the same tendency. That is to say, the ejecting pressure was the maximum when each metal powder was compacted under a compacting pressure of 588 MPa, and as the compacting pressure was higher, the ejecting pressure decreased. As for density of compacts obtained, as the compacting pressure was higher, the green density was higher.

These results demonstrate that by carrying out the method of forming a powder compact according to the present invention, practical low alloy steel powder can be formed into a high density compact with a low ejecting pressure.

Evaluation Test 10

An evaluation test was carried out for examining the relationship between the compacting pressure and the ejecting pressure in the case where the compaction temperature was set at 150° C. and lithium stearate was applied as a lubricant to the inner die surface and two types of metal powders were respectively compacted. Besides, examination was carried out about whether an iron stearate coating was formed on a compact surface or not.

Metal powder used was KIP103V produced by Kawasaki Steel Corporation and ASC100-29 produced by Hoganas Corporation. As mentioned above, KIP103V was an alloy steel prepared by adding 1% by weight of Cr powder, 0.3% by weight of Mo powder and 0.3% by weight of V powder to iron powder based on 100% by weight of the entire powder (Fe-1 wt. % Cr-0.3 wt. % Mo-0.3 wt. % V). On the other hand, ASC100-29 was pure iron (Fe).

In the case of employing KIP103V, the compacting pressure was 588 MPa, 686 MPa, 785 MPa, 883 MPa and 981 MPa, and the ejecting pressure was measured with respect to each compacting pressure. In the case of employing ASC100-29, the compacting pressure was 393 MPa, 490 MPa, 588 MPa, 686 MPa, 785 MPa, 883 MPa and 981 MPa, and the ejecting pressure was measured with respect to each compacting pressure.

Figure 20:
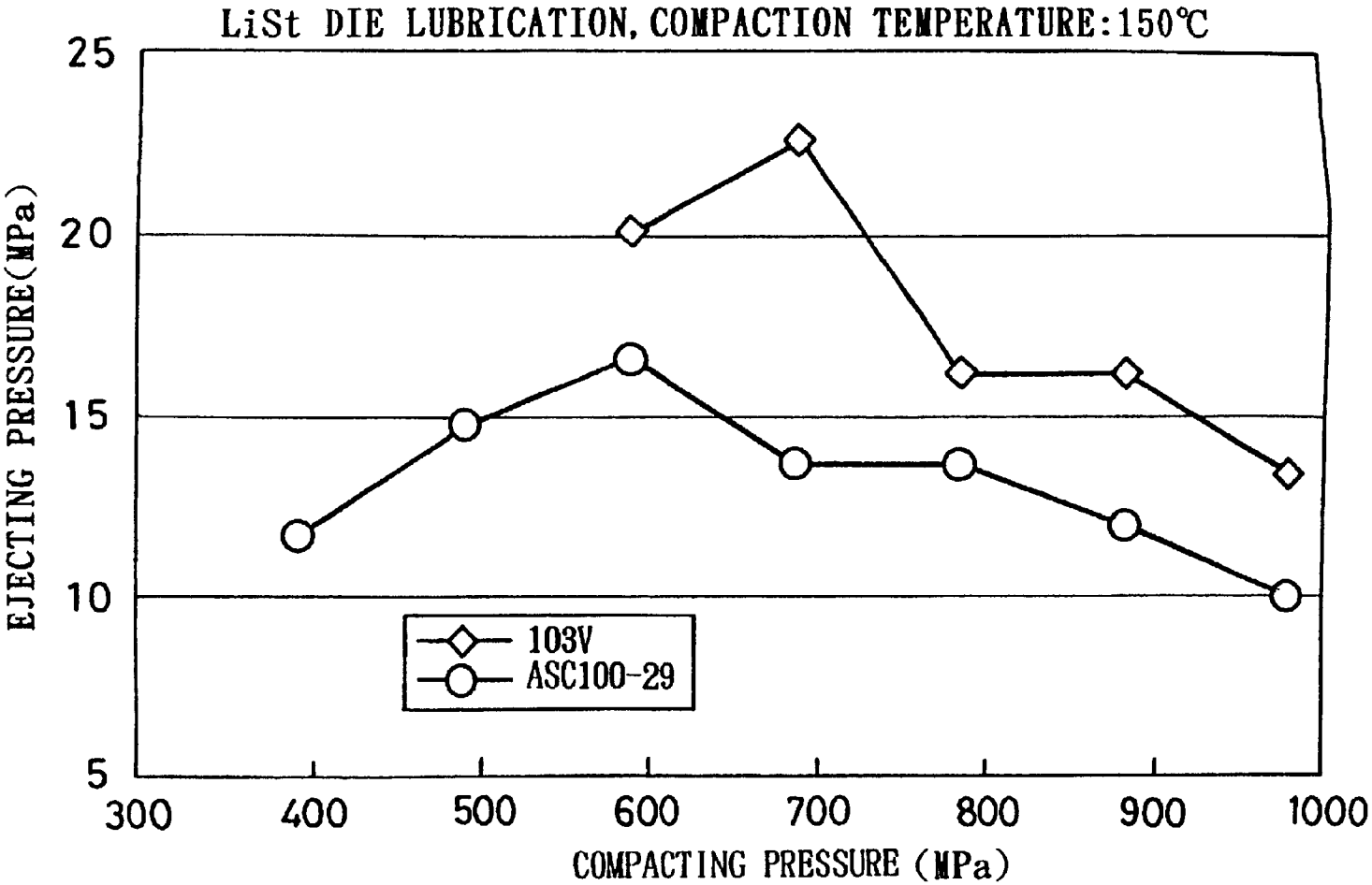
FIG. 20 is a graph showing the relationship between compacting pressure and ejecting pressure in Evaluation Test 10.

FIG. 20 shows the relationship between the compacting pressure and the ejecting pressure in the case of using these two types of metal powders. As understood from this figure, the ejecting pressure in the case of using KIP103V was higher than that in the case of employing ASC100-29. That is to say, it is understood that the ejecting pressure in the case of employing pure iron ASC100-29 was smaller than that in the case of employing KIP103V or iron added by Cr, Mo, and V. It is assumed from this fact that as the iron content in metal powder is larger, the amount of iron which is in contact with the inner die surface is larger and iron stearate is more easily formed.

Therefore, an examination was carried out about whether an iron stearate coating was formed on the surface of compacts or not when KIP103V and ASC100-29 were compacted under 588 MPa or 981 MPa. Detection of an iron stearate coating was carried out by TOF-SIMS analysis just in the same way as [Analysis of an Ejecting Pressure Decrease Phenomenon] mentioned later.

In the case of compacting KIP103V, no iron stearate coating was detected on the compact surface when the compacting pressure was 588 MPa, but an iron stearate coating was detected when the compacting pressure was 981 MPa. That is to say, it was confirmed that an iron stearate coating was formed when the compacting pressure was 981 MPa. On the other hand, in the case of compacting ASC100-29, an iron stearate coating was detected on the compact surface in both the cases where the compacting pressure was 588 MPa and 981 MPa. That is to say, it is clear that an iron stearate coating was formed on the compact surface. Considering that under a compacting pressure of 588 MPa, iron stearate was formed in the case of pure iron ASC100-29, but iron stearate was not formed in the case of iron alloy KIP103V, and that the ejecting pressure in the case of ASC100-29 was smaller than that in the case of KIP103V, it is assumed that the existence of an iron stearate coating reduced the ejecting pressure.

When KIP103V and ASC100-29 were respectively compacted under the same conditions except that zinc stearate was applied to the die surface instead of lithium stearate, iron stearate was detected in both the cases when the compacting pressure was 981 MPa. Also in the case of applying calcium stearate, iron stearate was detected when the compacting pressure was 981 MPa in both the cases of using KIP103V and ASC100-29. It is assumed from this fact that application of calcium stearate, zinc stearate or the like to the inner die surface also has an effect of decreasing the ejecting pressure.

Analysis of an Ejecting Pressure Decrease Phenomenon

The following analytic test was conducted for analyzing a phenomenon that in the case where lithium stearate is applied as a lubricant to an inner die surface and metal powder is compressed, the pressure for ejecting a compact decreases contrarily when the compacting pressure is high.

A die employed was the same as those used in (Formation of a Powder Compact) in the above [Preferred Embodiments] and heated to 150° C. Then lithium stearate of No. 2 prepared in the above (Preparation of Higher Fatty Acid) was sprayed to an inner surface of this die. Metal powder employed was alloy steel powder KIP103V produced by Kawasaki Steel Corporation. This alloy steel powder was heated to 150° C., charged into the die and compressed under two kinds of compacting pressures of 588 MPa and 981 MPa, thereby forming compacts.

The surface of the compacts formed under two kinds of compacting pressures were analyzed by TOF-SIMS. The analytic result is shown in FIG. 21.

Figure 21:
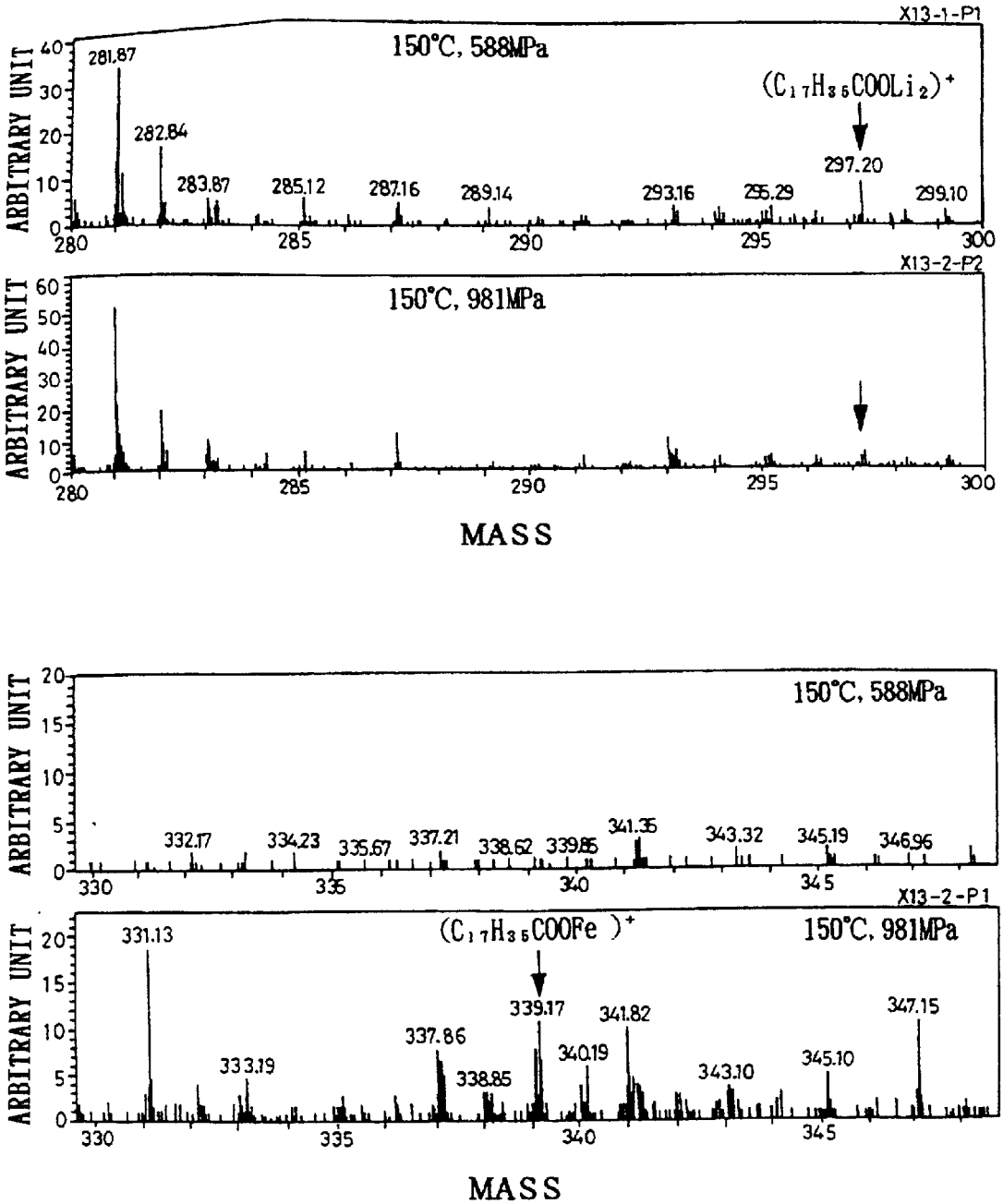
FIG. 21 is charts showing the results of TOF-SIMS.

As apparent from FIG. 21, lithium stearate was detected but little iron stearate was detected on the surface of the compact formed under a compacting pressure of 588 MPa. On the other hand, iron stearate was detected on the surface of the compact formed under a compacting pressure of 981 MPa.

This indicates that in the case of the compact formed under a compacting pressure of 588 MPa, lithium stearate as a lubricant physically adhered to the surface of iron powder, but in the case of the compact formed under a compacting pressure of 981 MPa, iron stearate chemically adhered to the surface of iron powder. This iron stearate is metallic soap and was produced by a chemical bond of lithium stearate and iron.

The coating thus chemically adhering has a stronger lubricating effect than the lubricant coating physically adhering, and exhibits excellent lubricating performance when compaction is carried out with a high pressure as in the present invention.

Advantages of the Present Invention

The forming method of the present invention can produce a high density sintered body only by compacting and sintering once.

The forming method of the present invention can reduce the pressure for ejecting a compact from a die. As a result, the surface of the compact becomes excellent and dimensional precision of the compact can be secured stably. Besides, since metal powder is compacted under a high pressure, a high density powder compact can be obtained.

Since the forming method of the present invention can eject a compact from a die with a low ejecting pressure, die abrasion can be reduced remarkably. Besides, lifetime of the die is elongated sharply and die costs can be reduced.

In the forming method of the present invention, in the case of employing a higher fatty acid lubricant dispersed in water, the lubricant can be uniformly applied to an inner surface of a die heated to a temperature which is at or below its melting point. Since no organic solvent is used, there is no fear of environmental contamination.

In the forming method of the present invention, when die temperature is below the melting point of a higher fatty acid lubricant, there does not arise a problem that the higher fatty acid lubricant is liquidified and makes metal powder lumpy.

In the forming method of the present invention, when metal powder is heated, a high density compact can be formed. Also pressure for ejecting a powder compact can be reduced.

In the forming method, when a higher fatty acid lubricant is added to metal powder in an amount of not less than 0.1% by weight and less than 0.6% by weight, metal powder flowability is improved and density of powder filled into a die can be increased.

In the method of forming a powder compact comprising the application step of applying a metal salt of higher fatty acid to an inner surface of a die heated to 100° C. or more, and the compaction step of filling iron powder into the die and compacting the iron powder under not less than 600 MPa, the ejecting pressure can be reduced and green density can be increased. Similar effects can be obtained in the case where a metal salt of higher fatty acid is a lithium salt, a calcium salt, or a zinc salt of higher fatty acid.

What is claimed is:

1. A method of forming a powder compact comprising:

applying a higher fatty acid lubricant which is dispersed into water containing a surfactant to an inner surface of a heated die which is heated to less than the melting point of said higher fatty acid lubricant; and filling metal powder into said die and compacting said metal powder under such a pressure that said higher fatty acid lubricant is chemically bonded with said metal powder to form a metallic soap coating which is different from said higher fatty acid lubricant.

2. The method of forming a powder compact of claim 1, wherein said higher fatty acid lubricant is a metal salt of a higher fatty acid.

3. The method of forming a powder compact of claim 2, wherein said metal salt of a higher fatty acid is a lithium salt, a calcium salt, or a zinc salt of a higher fatty acid.

4. The method of forming a powder compact of claim 5, wherein said higher fatty acid lubricant has a maximum particle diameter of less than 30 μm.

5. The method of forming a powder compact of claim 1, wherein said heated die has a temperature of 100° C. or more.

6. The method of forming a powder compact of claim 1, wherein said metal powder has been heated.

7. The method of forming a powder compact of claim 1, wherein said metal powder comprises iron powder.

8. The method of forming a powder compact of claim 7, wherein said metal powder further comprises said higher fatty acid lubricant.

9. The method of forming a powder compact of claim 8, wherein said metal powder further comprises said higher fatty acid lubricant.

10. The method of forming a powder compact of claim 11, wherein said metal powder comprises 0.1% or more by weight of said higher fatty acid lubricant.

11. A method of forming a powder compact comprising:

applying a metal salt of higher fatty acid to an inner surface of a die heated to 100° C. or more but less than the melting point of said metal salt of higher fatty acid; and charging iron powder into said die and compacting said iron powder at a pressure of 600 MPa or more, wherein the higher fatty acid of said metal salt is chemically bonded with said iron powder to form a metallic soap coating which is different from said metal salt of higher fatty acid.

12. The method of forming a powder compact of claim 11, wherein said metal salt of a higher fatty acid is a lithium salt, a calcium salt or a zinc salt of a higher fatty acid.

13. The method of forming a powder compact of claim 11, wherein said iron powder is compacted at a pressure of 785 MPa or more.

14. A method of forming a powder compact, comprising:

applying, to an inner surface of a die which has been heated to a die temperature of 100° C. or more, a dispersion fluid in which a metal salt of a higher fatty acid having a higher melting point than said die temperature is finely dispersed, thereby forming a coating of said metal salt of a higher fatty acid;

filling iron powder into said die and compacting said iron powder under a compacting pressure of 600 MPa or more, thereby providing a compact having a metallic soap coating on a surface which is in contact with said die; and ejecting and taking out said compact from said die, wherein the higher fatty acid of said metal salt is chemically bonded with said iron powder to form a metallic soap coating which is different from said metal salt of higher fatty acid.

15. A method of forming a powder compact comprising:

applying, to an inner surface of a die which has been heated to a die temperature of 100° C. or more, a dispersion fluid in which a metal salt of a fatty acid having a higher melting point higher than said die temperature is finely dispersed, thereby forming a coating of said metal salt of a higher fatty acid;

filling iron powder into said die and compacting said iron powder under a compacting pressure of 600 MPa or more, thereby providing a compact having a metallic soap coating, which is different from said metal salt of said higher fatty acid on a surface which is in contact with said die; and ejecting and taking out said compact from said die with an ejecting pressure of 3% or less of said compacting pressure.

16. The method of forming a powder compact of claim 14, wherein said compacting pressure is 686 MPa or more and said powder compact is removed from a die with an ejecting pressure of 8 MPa or less.

17. The method of forming a powder compact of claim 14, wherein said compacting pressure is 700 MPa or more and having an ejecting pressure of ejecting pressure of 15 MPa or less.

18. The method of forming a powder compact of claim 14, wherein said compacting pressure is 700 MPa or more and having an ejecting pressure of ejecting pressure of 13 MPa or less.

19. The method of forming a powder compact of claim 14, wherein said compacting pressure is 700 MPa or more and having an ejecting pressure of ejecting pressure of 10 MPa or less.

20. The method of forming a powder compact of claim 14, wherein said metal salt dispersed in said dispersion fluid has a maximum particle diameter of 30 μm or less.

* * * * *